US008972122B2

(12) United States Patent
Magaki et al.

(10) Patent No.: US 8,972,122 B2
(45) Date of Patent: Mar. 3, 2015

(54) SHOVEL AND METHOD FOR CONTROLLING SHOVEL

(75) Inventors: Hideto Magaki, Chiba (JP); Ryuji Shiratani, Chiba (JP)

(73) Assignee: Sumitomo (S.H.I.) Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/003,526

(22) PCT Filed: Mar. 6, 2012

(86) PCT No.: PCT/JP2012/055703
§ 371 (c)(1),
(2), (4) Date: Sep. 6, 2013

(87) PCT Pub. No.: WO2012/121253
PCT Pub. Date: Sep. 13, 2012

(65) Prior Publication Data

US 2014/0088839 A1 Mar. 27, 2014

(30) Foreign Application Priority Data

Mar. 8, 2011 (JP) ..... 2011-050790
Mar. 24, 2011 (JP) ..... 2011-066732
Apr. 22, 2011 (JP) ..... 2011-096414

(51) Int. Cl.
*G06F 7/70* (2006.01)
*E02F 9/22* (2006.01)
*E02F 9/20* (2006.01)

(52) U.S. Cl.
CPC ..... *E02F 9/2203* (2013.01); *E02F 9/2214* (2013.01); *E02F 9/2282* (2013.01); *E02F 9/2285* (2013.01); *E02F 9/2292* (2013.01); *E02F 9/2296* (2013.01); *E02F 9/2075* (2013.01); *E02F 9/2235* (2013.01); *E02F 9/2246* (2013.01)
USPC ..... 701/50

(58) Field of Classification Search
None
See application file for complete search history.

(56) References Cited

U.S. PATENT DOCUMENTS 4,896,582 A 1/1990 Tordenmalm et al.
6,047,228 A 4/2000 Stone et al.
(Continued)

FOREIGN PATENT DOCUMENTS

EP 0915208 A1 5/1999
JP 2002-004339 1/2002
(Continued)

OTHER PUBLICATIONS

International Search Report mailed on Jun. 12, 2012.
(Continued)

*Primary Examiner* — Thomas Tarcza
*Assistant Examiner* — Adam Alharbi
(74) *Attorney, Agent, or Firm* — IPUSA, PLLC

(57) ABSTRACT

A shovel includes a boom 4 or an arm 5 driven by a hydraulic oil discharged from a main pump 12. The shovel also includes a pressure sensor 17A which detects an operating condition of the boom 4, an arm angle sensor S1 which detects an arm angle β, a body stability determining part 300 which determines a body stability degree of the shovel based on the arm angle β and an operating condition of the boom 4, and a discharge rate controlling part 301 which decreases a horsepower of the main pump 12 if it is determined by the body stability determining part that a body stability degree becomes lower than or equal to a predetermined level.

20 Claims, 19 Drawing Sheets

(56) References Cited

U.S. PATENT DOCUMENTS

| | | | | |
|---|---|---|---|---|
| 6,257,118 | B1 | 7/2001 | Wilbur et al. | |
| 2004/0098984 | A1 | 5/2004 | Duell et al. | |
| 2008/0142232 | A1 | 6/2008 | Palmer et al. | |
| 2010/0034630 | A1 * | 2/2010 | Kobata | 414/694 |
| 2012/0057956 | A1 | 3/2012 | Shirao et al. | |
| 2012/0082536 | A1 | 4/2012 | Kawashima et al. | |
| 2012/0089288 | A1 | 4/2012 | Kawashima | |
| 2012/0274121 | A1 * | 11/2012 | Minoshima et al. | 298/22 R |
| 2013/0073151 | A1 * | 3/2013 | Wada et al. | 701/50 |

FOREIGN PATENT DOCUMENTS

| | | |
|---|---|---|
| JP | 2004-100814 | 4/2004 |
| JP | 2009-155901 | 7/2009 |
| WO | 2010131654 | 11/2010 |
| WO | WO 2010/143628 | 12/2010 |
| WO | WO 2010/147121 | 12/2010 |

OTHER PUBLICATIONS

US Office Action mailed Oct. 10, 2014.

* cited by examiner

SHOVEL AND METHOD FOR CONTROLLING SHOVEL

TECHNICAL FIELD

The present invention relates to a shovel including an attachment including a boom and an arm, and to a method for controlling the shovel. In particular, the present invention relates to a shovel which improves a body stability and energy efficiency in a case of operating the attachment in an unstable posture, and to a method for controlling the shovel.

BACKGROUND ART

A hydraulic circuit control device for a construction machine is known (see e.g., PATENT DOCUMENT 1). The hydraulic circuit control device for a construction machine reduces a shock on a hydraulic shovel attributable to a posture of an attachment without aggravating an operability.

Specifically, the hydraulic circuit control device in PATENT DOCUMENT 1 limits an amount of change in a boom controlling value within a predetermined range when it operates a boom in a case where an operating radius is greater than or equal to a predetermined value and an open angle of an arm is greater than or equal to a predetermined angle.

Thus, the hydraulic circuit control device in PATENT DOCUMENT 1 slows down a movement of the boom so that it may reduce a shock on the hydraulic shovel at the time of stopping the boom.

RELATED ART DOCUMENT

Patent Document

Patent Document 1: Japanese Unexamined Patent Publication No. 2004-100814

DISCLOSURE OF THE INVENTION

Problem to be Solved by the Invention

However, the hydraulic circuit control device in PATENT DOCUMENT 1 directly changes the boom controlling value itself by limiting an amount of change in the boom controlling value within the predetermined range, and thus slows down a movement of the boom. Thus, even if it can reduce a shock on the hydraulic shovel at the time of stopping the boom, it does not improve energy efficiency because it leaves a main pump and an engine operative as it is.

In view of the above, it is an objective of the present invention to provide a shovel which improves a body stability and energy efficiency simultaneously in a case of operating an attachment in an unstable posture and a method for controlling the shovel.

Means for Solving the Problem

To achieve the above objective, a shovel according to an embodiment of the present invention includes a front working machine driven by a hydraulic oil discharged from a main pump, a front working machine condition detecting part configured to detect a condition of the front working machine, an attachment condition determining part configured to determine a body stability degree of the shovel based on the condition of the front working machine, and an operating condition switching part configured to decrease a horsepower of the main pump if it is determined by the attachment condition determining part that the body stability degree becomes lower than or equal to a predetermined level.

Also, a method for controlling a shovel according to an embodiment of the present invention is a method for controlling a shovel including a front working machine driven by a hydraulic oil discharged from a main pump. The method includes a front working machine condition detecting step of detecting a condition of the front working machine, an attachment condition determining step of determining a body stability degree of the shovel based on the condition of the front working machine, and an operating condition switching step of decreasing a horsepower of the main pump if it is determined that the body stability degree becomes lower than or equal to a predetermined level in the attachment condition determining step.

Effects of the Invention

According to the above means, the present invention can provide a shovel which improves a body stability and energy efficiency simultaneously in a case of operating an attachment in an unstable posture and a method for controlling the shovel.

MODE FOR CARRYING OUT THE INVENTION

In what follows, with reference to the accompanying drawings, there will be explained about preferred embodiments of the present invention.

First Embodiment

Figure 1:
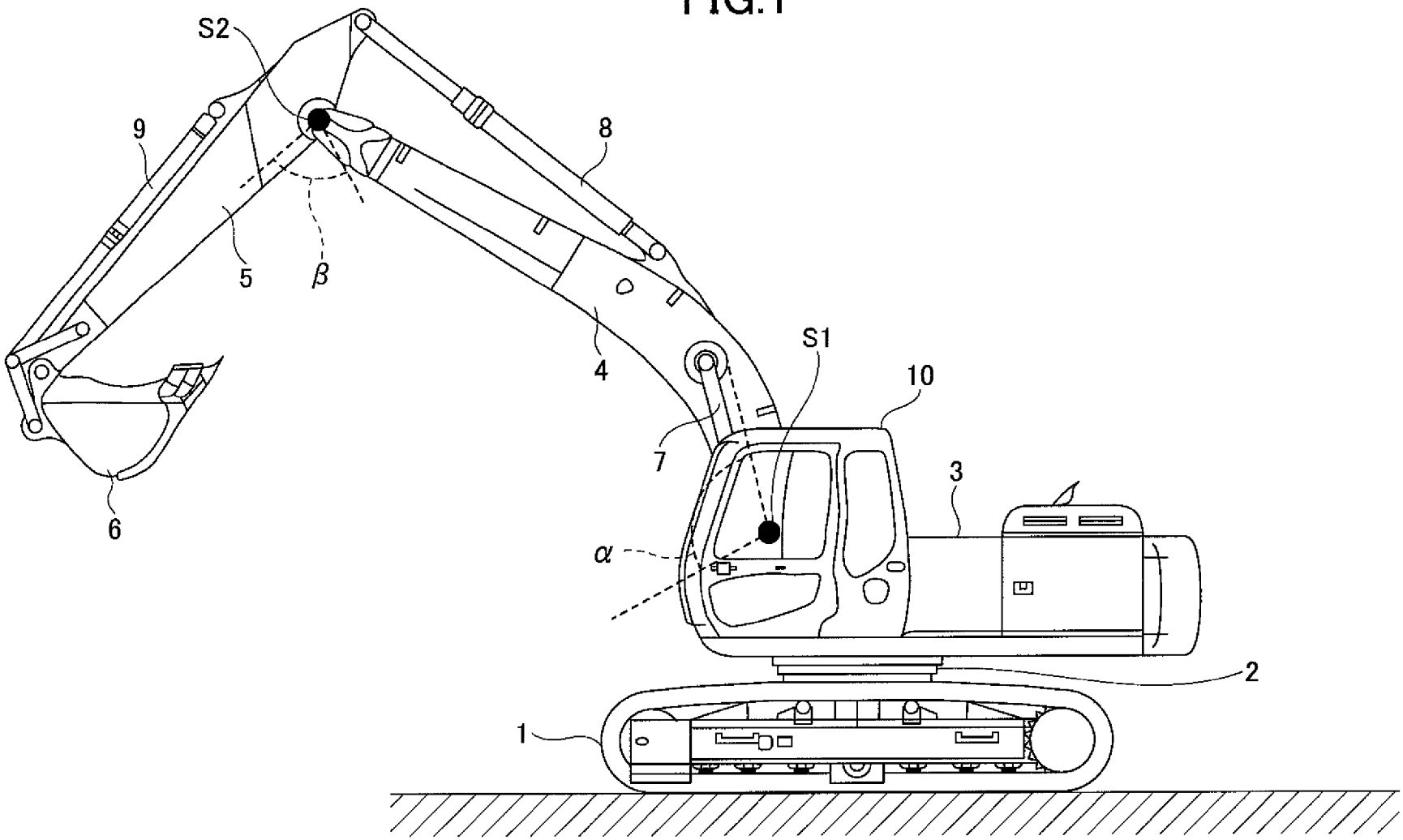
FIG. 1 is a diagram showing a configuration example of a hydraulic shovel according to an embodiment of the present invention.

FIG. 1 is a side view of a hydraulic shovel according to a first embodiment of the present invention. The hydraulic shovel turnably mounts an upper turning body 3 on a crawler-type lower running body 1 via a turning mechanism 2.

A boom 4 as a front working machine is attached to the upper turning body 3. An arm 5 as a front working machine is attached to a leading end of the boom 4. A bucket 6 as a front working machine and as an end attachment is attached to a leading end of the arm 5. The boom 4, the arm 5, and the bucket 6 constitute an attachment. Also, the boom 4, the arm 5, and the bucket 6 are hydraulically driven by a boom cylinder 7, an arm cylinder 8, and a bucket cylinder 9, respectively. A cabin 10 is arranged in the upper turning body 3, and a power source such as an engine is mounted to the upper turning body 3. In FIG. 1, the bucket 6 is shown as the end attachment. However, the bucket 6 may be replaced by a lifting magnet, a breaker, a fork, or the like.

The boom 4 is supported by the upper turning body 3 at a pivotally supporting part (at a joint) so that it can be lifted and lowered in relation to the upper turning body 3. A boom angle sensor S1 as a front-working-machine-condition detecting part (a boom operating condition detecting part) is attached to the pivotally supporting part. A boom angle $\alpha$, which is an inclination angle of the boom 4 and a climb angle from a most lowered state of the boom 4, can be detected by the boom angle sensor S1.

The arm 5 is supported by the boom 4 at a pivotally supporting part (at a joint) so that it can be pivoted in relation to the boom 4. An arm angle sensor S2 as an arm-operating-condition detecting part is attached to the pivotally supporting part. An arm angle $\beta$, which is an inclination angle of the arm 5 and an open angle from a most closed state of the arm 5, can be detected by the arm angle sensor S2.

Figure 2:
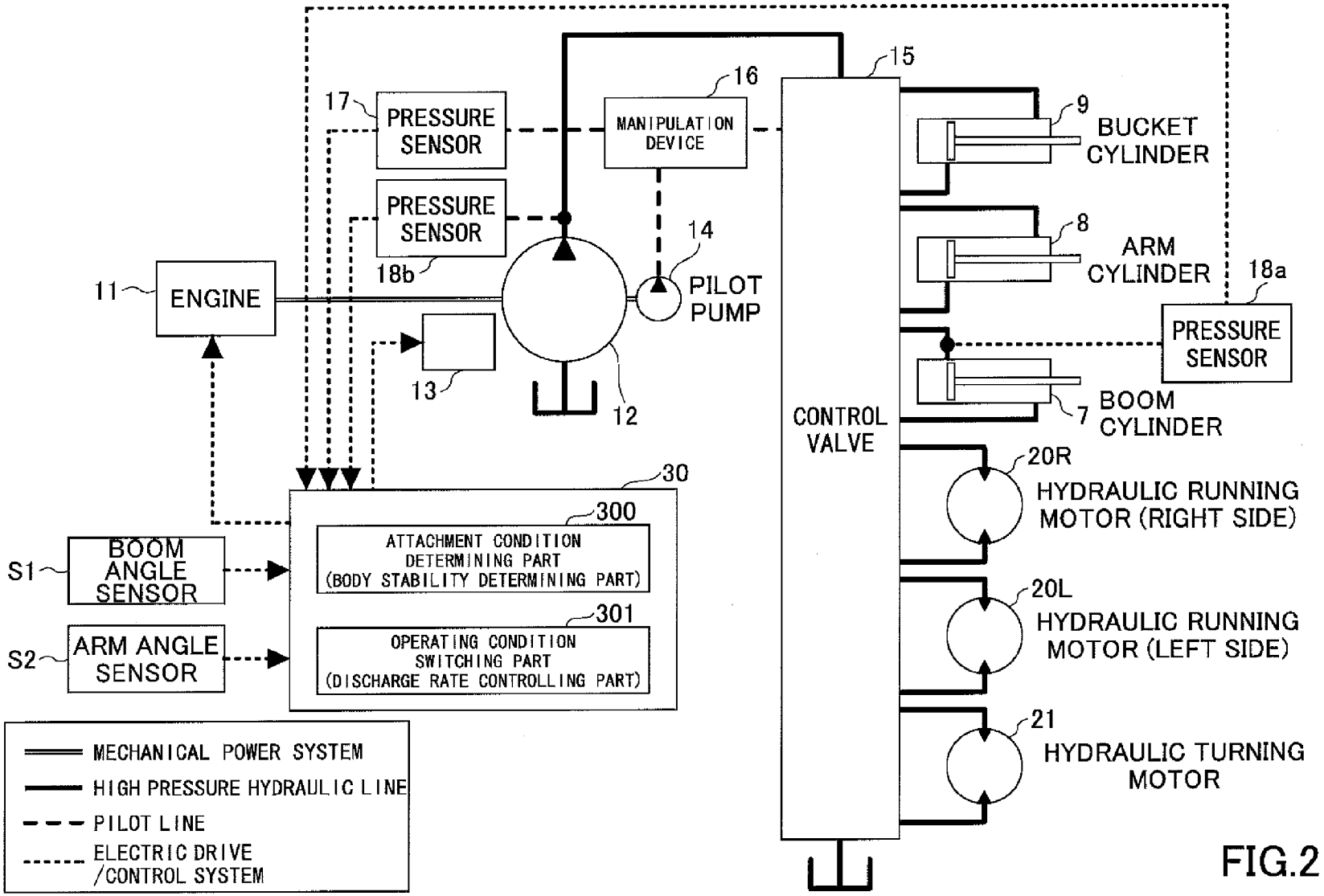
FIG. 2 is a first block diagram showing a configuration example of a drive system of the hydraulic shovel.

FIG. 2 is a block diagram showing a configuration example of a drive system of a hydraulic shovel. In FIG. 2, a mechanical power system, a high pressure hydraulic line, a pilot line, and an electric drive/control system are indicated by a double line, a solid line, a dashed line, and a dotted line, respectively.

The drive system of the hydraulic shovel mainly includes an engine 11, a main pump 12, a regulator 13, a pilot pump 14, a control valve 15, a manipulation device 16, a pressure sensor 17, a boom cylinder pressure sensor 18*a*, a discharge pressure sensor 18*b*, and a controller 30.

An engine 11 is a drive source of the hydraulic shovel, for example, an engine which operates to maintain a predetermined rotational speed. An output shaft of the engine 11 is coupled to input shafts of the main pump 12 and the pilot pump 14.

The main pump 12 is a device configured to supply a hydraulic oil to the control valve 15 via a high pressure hydraulic line. For example, the main pump 12 is a variable displacement swash plate type hydraulic pump.

The regulator 13 is a device configured to regulate a discharge rate of the main pump 12. For example, the regulator 13 regulates a discharge rate of the main pump 12 by adjusting a swash plate tilt angle of the main pump 12 depending on a discharge pressure of the main pump 12, a control signal from the controller 30, or the like.

The pilot pump 14 is a device configured to supply a hydraulic oil to various hydraulic control instruments via pilot lines. For example, the pilot pump 14 is a fixed displacement type hydraulic pump.

The control valve 15 is a hydraulic control device configured to control a hydraulic system in the hydraulic shovel. For example, the control valve 15 supplies a hydraulic oil received from the main pump 12 to one or more of the boom cylinder 7, the arm cylinder 8, the bucket cylinder 9, a hydraulic running motor 20L (for a left side), a hydraulic running motor 20R (for a right side), and a hydraulic turning motor 21, selectively. In what follows, the boom cylinder 7, the arm cylinder 8, the bucket cylinder 9, the hydraulic running motor 20L (for the left side), the hydraulic running motor 20R (for the right side), and the hydraulic turning motor 21 are collectively referred to as a "hydraulic actuators".

The manipulation device 16 is a device used by an operator to operate the hydraulic actuators. The manipulation device 16 supplies a hydraulic oil received from the pilot pump 14 to a pilot port of a flow control valve corresponding to each of the hydraulic actuators via a pilot line. A pressure (a pilot pressure) of the hydraulic oil supplied to each of the pilot ports corresponds to a direction and an amount of manipulation of a lever or a pedal (not shown) of the manipulation device 16 corresponding to each of the hydraulic actuators.

The pressure sensor 17 is a sensor configured to detect a manipulation content of the manipulation device 16 by an operator. For example, the pressure sensor 17 detects a direction and an amount of manipulation of a lever or a pedal of the manipulation device 16 corresponding to each of the hydraulic actuators in a form of a pressure. Then, the pressure sensor 17 outputs a detection value to the controller 30. The manipulation content of the manipulation device 16 may be detected by a sensor other than the pressure sensor.

The boom cylinder pressure sensor 18*a* is an example of the boom operating condition detecting part configured to detect a condition of a boom manipulating lever. For example, the boom cylinder pressure sensor 18*a* detects a pressure in a bottom-side chamber of the boom cylinder 7, and outputs a detection value to the controller 30.

The discharge pressure sensor 18*b* is another example of the boom operating condition detecting part. For example, the discharge pressure sensor 18*b* detects a discharge pressure of the main pump 12, and outputs a detection value to the controller 30.

The controller 30 is a control device configured to control movement paces of the hydraulic actuators. For example, the controller 30 is a computer including a Central Processing Unit (CPU), a Random Access Memory (RAM), a Read Only Memory (ROM), and the like. Also, the controller 30 reads out a program corresponding to each of a body stability determining part 300 as an attachment condition determining part and a discharge rate controlling part 301 as an operating condition switching part from the ROM, loads the program on to the RAM, and causes the CPU to perform a process corresponding to each program.

Specifically, the controller 30 receives detection values of the boom angle sensor S1, the arm angle sensor S2, the pressure sensor 17, the boom cylinder pressure sensor 18*a*, the discharge pressure sensor 18*b*, and the like. Then, the controller 30 performs a process by each of the body stability determining part 300 and the discharge rate controlling part 301 based on the detection values. Then, the controller 30 appropriately outputs to the engine 11 or the regulator 13 a control signal corresponding to each of processing results of the body stability determining part 300 and the discharge rate controlling part 301.

More specifically, the body stability determining part 300 in the controller 30 determines whether a body stability degree of the hydraulic shovel during stopping the boom 4 becomes lower than or equal to a predetermined level. Then, if the body stability determining part 300 determines that the body stability degree of the hydraulic shovel becomes lower than or equal to the predetermined level, the discharge rate controlling part 301 in the controller 30 adjusts the regulators 13L, 13R, and decreases discharge rates of the main pumps 12L, 12R. Hereinafter, a state where a discharge rate of the main pump 12 is decreased is referred to as a "discharge rate decreased state", and a state before being switched to a discharge rate decreased state is referred to as a "normal state".

Figure 3:
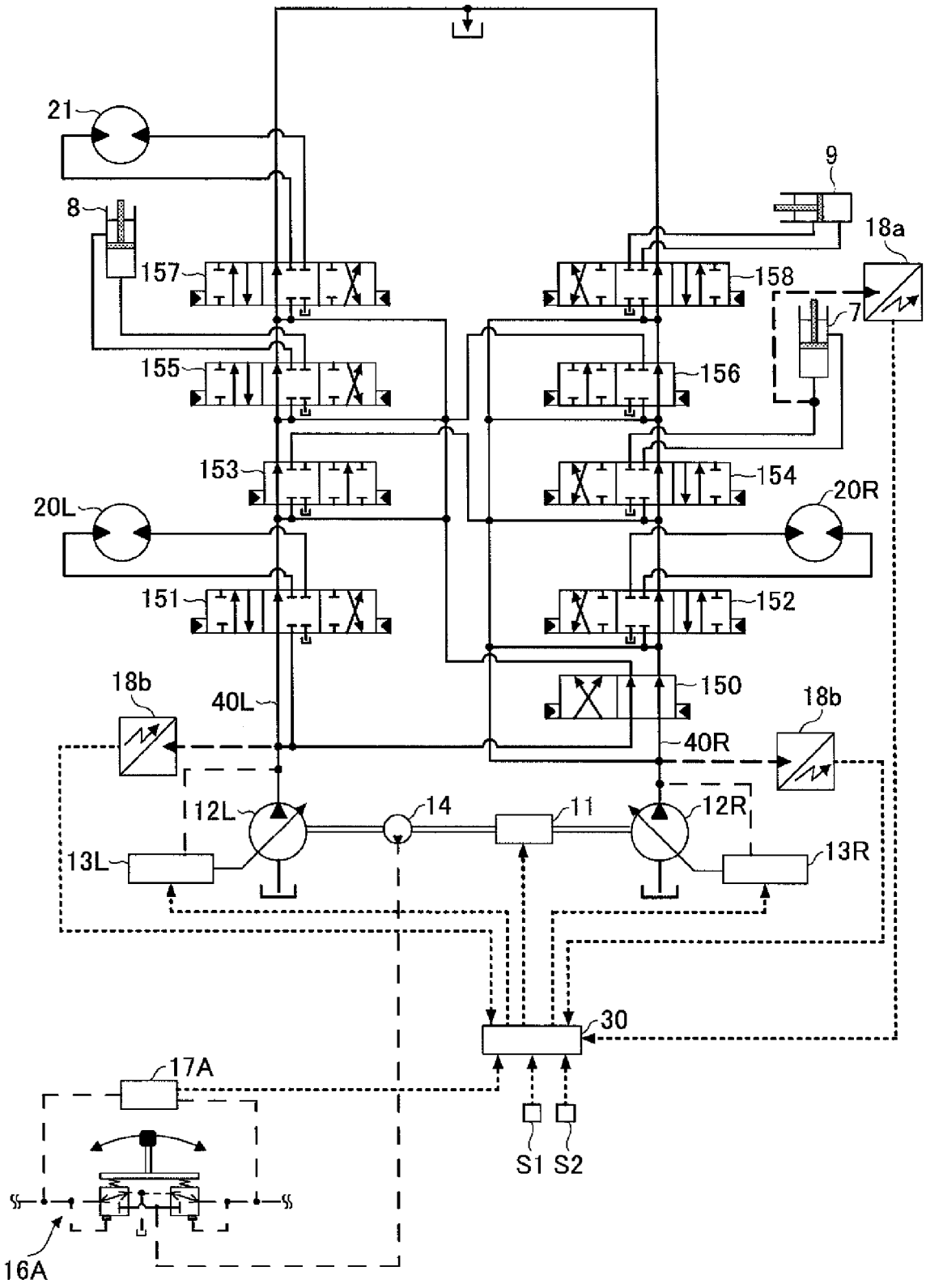
FIG. 3 is a first schematic diagram showing a configuration example of a hydraulic system installed in the hydraulic shovel.

Next, referring to FIG. 3, there will be explained about a mechanism which changes a discharge rate of the main pump 12. FIG. 3 is a schematic diagram showing a configuration example of the hydraulic system installed in the hydraulic shovel according to the first embodiment. In FIG. 3, as is the case in FIG. 2, a mechanical power system, a high pressure hydraulic line, a pilot line, and an electric drive/control system are indicated by a double line, a solid line, a dashed line, and a dotted line, respectively.

In the first embodiment, the hydraulic system circulates the hydraulic oil from the main pump 12 (two main pumps 12L, 12R) driven by the engine 11 to a hydraulic oil tank via each of center bypass hydraulic lines 40L, 40R.

The center bypass hydraulic line 40L is a high pressure hydraulic line passing through flow control valves 151, 153, 155, and 157 arranged in the control valve 15.

The center bypass hydraulic line 40R is a high pressure hydraulic line passing through flow control valves 150, 152, 154, 156, and 158 arranged in the control valve 15.

The flow control valves 153, 154 are spool valves configured to control a flow of the hydraulic oil in order to supply the hydraulic oil discharged from the main pumps 12L, 12R to the boom cylinder 7, and in order to drain the hydraulic oil in the boom cylinder 7 into the hydraulic oil tank. Also, the flow control valve 154 is a spool valve configured to operate all the time when a boom manipulating lever 16A is manipulated (hereinafter referred to as a "first boom flow control valve"). Also, the flow control valve 153 is a spool valve configured to operate only when the boom manipulating lever 16A is manipulated beyond a predetermined amount of manipulation (hereinafter referred to as a "second boom flow control valve").

Also, the flow control valves 155, 156 are spool valves configured to control a flow of the hydraulic oil in order to supply the hydraulic oil discharged from the main pumps 12L, 12R to the arm cylinder 8, and in order to drain the hydraulic oil in the arm cylinder 8 into the hydraulic oil tank. Also, the flow control valve 155 is a spool valve configured to operate all the time when an arm manipulating lever (not shown) is manipulated (hereinafter referred to as a "first arm flow control valve"). Also, the flow control valve 156 is a spool valve configured to operate only when the arm manipulating lever is manipulated beyond a predetermined amount of manipulation (hereinafter referred to as a "second arm flow control valve").

The flow control valve 157 is a spool valve configured to control a flow of the hydraulic oil in order to circulate the hydraulic oil discharged from the main pump 12L in the hydraulic turning motor 21.

The flow control valve 158 is a spool vale configured to supply the hydraulic oil discharged from the main pump 12R to the bucket cylinder 9, and to drain the hydraulic oil in the bucket cylinder 9 into the hydraulic oil tank.

The regulators 13L, 13R are configured to regulate discharge rates of the main pumps 12L, 12R, by adjusting swash plate tilt angles of the main pumps 12L, 12R depending on discharge pressures of the main pumps 12L, 12R (i.e., under a total horsepower control). Specifically, the regulators 13L, 13R decrease the discharge rates by adjusting the swash plate tilt angles of the main pumps 12L, 12R if the discharge pressures of the main pumps 12L, 12R have become greater than or equal to a predetermined value. This is to prevent a pump horsepower, which is represented by a product of its discharge rate and its discharge pressure, from exceeding an output horsepower of the engine 11.

The boom manipulating lever 16A is an example of the manipulation device 16, and a manipulation device configured to operate the boom 4. The boom manipulating lever 16A uses the hydraulic oil discharged from the pump 14, and applies a control pressure corresponding to an amount of lever manipulation on a left side pilot port or a right side pilot port of the first boom flow control valve 154. In the first embodiment, the boom manipulating lever 16A injects the hydraulic oil into a left side pilot port or a right side pilot port of the second boom flow control valve 153, too, if an amount of lever manipulation is beyond a predetermined amount of manipulation.

A pressure sensor 17A is an example of the pressure sensor 17. The pressure sensor 17A detects an operator's manipulation content (e.g., a direction of lever manipulation and an amount of lever manipulation (an angle of lever manipulation)) to the boom manipulating lever 16A in a form of a pressure, and outputs a detection value to the controller 30.

A left and a right running body manipulating levers (or pedals), an arm manipulating lever, a bucket manipulating lever, and a turning body manipulating lever (all not shown) are manipulation devices configured to control running of the lower running body 1, opening and closing of the arm 5, opening and closing of the bucket 6, and turning of the upper turning body 3, respectively. As is the case in the boom manipulating lever 16A, these manipulation devices use the hydraulic oil discharged from the pilot pump 14, and apply a control pressure corresponding to an amount of lever manipulation (or pedal manipulation) on a left side pilot port or a right side pilot port of a flow control valve corresponding to each of the hydraulic actuators. Also, as is the case in the pressure sensor 17A, the operator's manipulation content (the direction and amount of lever manipulation) to each of these manipulation devices is detected by a corresponding pressure sensor in a form of a pressure. Then, the corresponding pressure sensor outputs a detection value to the controller 30.

The controller 30 receives an output of a sensor such as the boom angle sensor S1, the arm angle sensor S2, the pressure sensor 17, the boom cylinder pressure sensor 18*a*, the discharge pressure sensor 18*b*, and the like. Then, the controller 30 outputs a control signal to the regulators 13L, 13R, as needed, so as to change discharge rates of the main pumps 12L, 12R.

Next, referring to FIG. 4, there will be explained about a detail of the body stability determining part 300 and discharge rate controlling part 301 in the controller 30.

Figure 4:
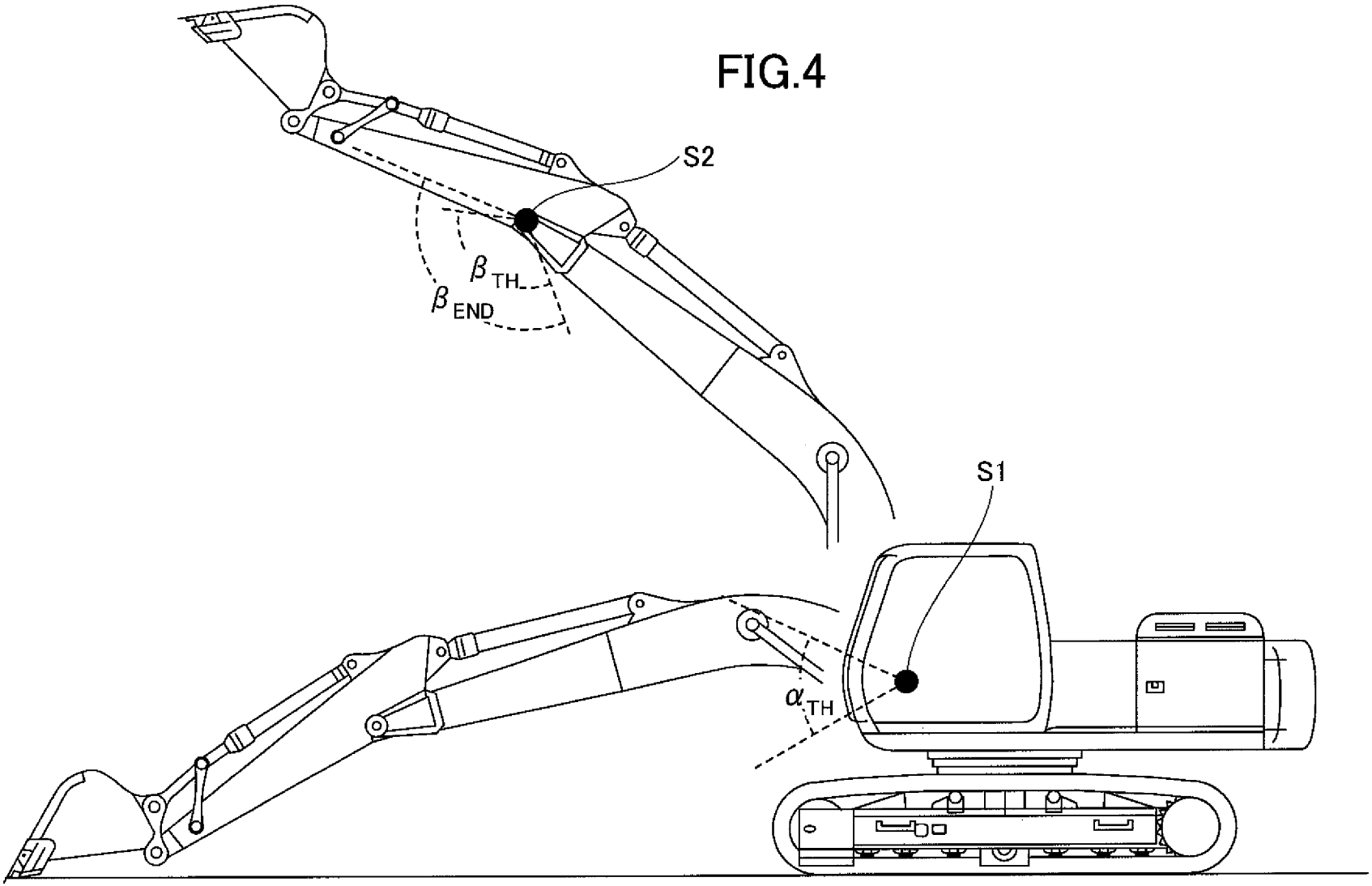
FIG. 4 is a diagram showing an example of a control-required state.

FIG. 4 is a schematic diagram showing an example of a state of the hydraulic shovel in a case where it is determined that a body stability degree of the hydraulic shovel becomes lower than or equal to a predetermined level and that a decrease in a discharge rate of the main pump 12 is necessary (hereinafter referred to as a "control-required state").

A control-required state is defined as a state where the boom angle $\alpha$ is greater than or equal to a threshold value $\alpha_{TH}$, the arm angle $\beta$ is greater than or equal to a threshold value $\beta_{TH}$, and the boom manipulating lever, which had been manipulated toward a direction of lever manipulation for lifting or lowering the boom 4, has been returned toward a direction of a neutral position. Preferably, the threshold value $\beta_{TH}$ may be within 10 degrees from a maximum angle $\beta_{END}$ (an arm angle at a most opened state of the arm 5) (i.e., $\beta_{END}-\beta_{TH}\leq 10°$). More preferably, the threshold value $\beta_{TH}$ may be within 5 degrees from a maximum angle $\beta_{END}$ (i.e. $\beta_{END}-\beta_{TH}\leq 5°$).

The body stability determining part 300 is a functional element configured to determine whether a body stability degree of the hydraulic shovel is lower than or equal to a predetermined level.

The "body stability degree" represents a degree of stability of a body of the hydraulic shovel. For example, a body stability degree, in a case of stopping the boom 4 while keeping the arm angle $\beta$ greater than or equal to the threshold value $\beta_{TH}$, is lower than a body stability degree in a case of stopping the boom 4 while keeping the arm angle $\beta$ lower than the threshold value $\beta_{TH}$. This is because an inertia moment of the attachment, in a case where the arm angle $\beta$ is greater than or equal to the threshold value $\beta_{TH}$, is greater than an inertia moment of the attachment in a case where the arm angle $\beta$ is lower than the threshold value $\beta_{TH}$, and thus a return action at the time of stopping the boom 4 in the former case is greater than that is the latter case.

Specifically, the body stability determining part 300 determines whether the boom angle $\alpha$ outputted by the boom angle sensor S1 is greater than or equal to the threshold value $\beta_{TH}$. This is to determine whether the attachment is engaging in an excavation operation. In this case, if the boom angle $\alpha$ is lower than the threshold value $\alpha_{TH}$, it is determined that the bucket 6 is located under a ground surface where the crawler is located and thus the attachment is in the excavation operation. In contrast, if the boom angle $\alpha$ is greater than or equal to the threshold value $\alpha_{TH}$, it is determined that the bucket 6 is located above the ground surface where the crawler is located and thus the attachment is not in the excavation operation. Also, the body stability determining part 300 may determine whether the attachment is in the excavation operation based on an output of the boom cylinder pressure sensor 18*a* which detects a pressure in the boom cylinder 7, the discharge pressure sensor 18*b* which detects a discharge pressure of the main pump 12, a stroke sensor (not shown) which detects a stroke amount of the boom cylinder 7, or the like, instead of based on the boom angle $\alpha$.

Also, the body stability determining part 300 determines whether the arm angle $\beta$ outputted by the arm angle sensor S2 is greater than or equal to the threshold value $\beta_{TH}$.

Moreover, the body stability determining part 300 determines whether the boom manipulating lever 16A (see FIG. 3) has been returned toward a direction of a neutral position based on a change in an amount of manipulation of the boom manipulating lever 16A outputted by the pressure sensor 17 (see FIG. 3). This is to determine whether an operator intends to stop the boom 4.

Also, the determination whether the boom angle $\alpha$ is greater than or equal to the threshold value $\alpha_{TH}$, the determination whether the arm angle $\beta$ is greater than or equal to the threshold value $\beta_{TH}$, and the determination whether the boom manipulating lever 16A has been returned toward the direction of the neutral position, may be performed in random order. Also, the three determinations may be performed simultaneously.

Subsequently, the body stability determination part 300 determines that a body stability degree of the hydraulic shovel has become lower than or equal to a predetermined level if the body stability determination part 300 determines that the boom angle $\alpha$ is greater than or equal to the threshold value $\alpha_{TH}$, that the arm angle $\beta$ is greater than or equal to the threshold value $\beta_{TH}$, and that the boom manipulating lever 16A has been returned toward the direction of the neutral position. This is because a return action to the attachment is estimated to become greater in a case of stopping the boom 4 while keeping the arm 5 wide open.

Also, if the body stability determination part 300 determines that the arm angle $\beta$ is greater than or equal to the threshold value $\beta_{TH}$ and that the boom manipulating lever 16A has been returned toward the direction of the neutral position, independently of a value of the boom angle $\alpha$, the body stability determining part 300 may determine that a body stability degree of the hydraulic shovel becomes lower than or equal to the predetermined level. This is because the attachment is not always in the excavation operation even if the bucket 6 is located under a ground surface where the crawler is located.

Also, the body stability determining part 300 may determine whether the boom angle $\alpha$ is greater than or equal to the threshold value $\alpha_{TH}$, or whether the arm angle $\beta$ is greater than or equal to the threshold value $\beta_{TH}$, based on an output of a proximity sensor, a stroke sensor (both not shown), or the like which detects that the boom 4 or the arm 5 has been lifted or opened to a predetermined angle.

Also, the body stability determining part 300 may determine whether a decrease in magnitude of the change per unit time $\Delta\alpha$ of the boom angle $\alpha$ has started, based on a change in the boom angle $\alpha$ outputted by the boom angle sensor S1, and thus may determine that an operator has started to stop the boom 4. In this case, the body stability determining part 300 may determine that a body stability degree of the hydraulic shovel at the time of stopping the boom 4 becomes lower than or equal to the predetermined level if the body stability determining part 300 determines that the arm angle $\beta$ is greater than or equal to the threshold value $\beta_{TH}$ and that a decrease in $\Delta\alpha$ has started.

The discharge rate controlling part 301 is a functional element configured to control a discharge rate of the main pump 12. For example, the discharge rate controlling part 301 changes a discharge rate of the main pump 12 by outputting a control signal to the engine 11 or the regulator 13.

Specifically, the discharge rate controlling part 301 outputs a control signal to the engine 11 or the regulator 13 if the body stability determining part 300 has determined that a body stability degree of the hydraulic shovel becomes lower than or equal to a predetermined level.

Next, referring to FIG. 5, there will be explained about a process in which the controller 30 gets a reduction in a discharge rate of the main pump 12 started (hereinafter referred to as a "discharge rate reduction start determining process").

Figure 5:
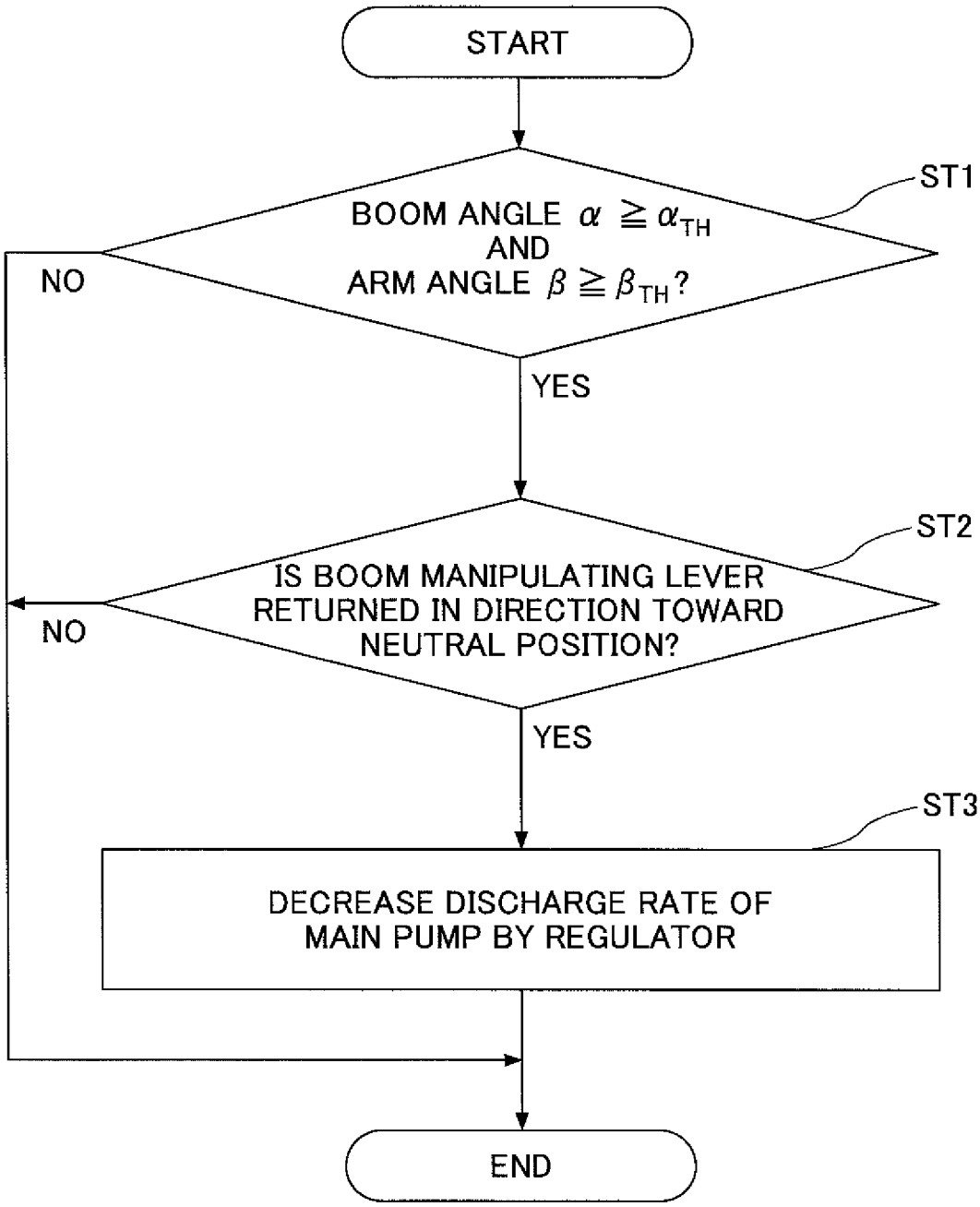
FIG. 5 is a first flowchart showing a flow of a discharge rate reduction start determining process.

Also, FIG. 5 is a flowchart showing a flow of the discharge rate reduction start determining process. The controller 30 repeatedly performs this discharge rate reduction start determining process at predetermined intervals until the discharge rate controlling part 301 gets a reduction in a discharge rate of the main pump 12.

Firstly, the body stability determining part 300 in the controller 30 determines whether a body stability degree of the hydraulic shovel at the time of stopping the boom 4 becomes lower than or equal to a predetermined level, i.e., whether an operator intends to stop the boom 4 while keeping the arm 5 wide open.

Specifically, the body stability determining part 300 in the controller 30 determines whether the boom angle $\alpha$ is greater than or equal to the threshold value $\alpha_{TH}$ and the arm angle $\beta$ is greater than or equal to the threshold value $\beta_{TH}$ (step ST1).

If the controller 30 determines that the boom angle $\alpha$ is lower than the threshold value $\alpha_{TH}$ or the arm angle $\beta$ is lower than the threshold value $\beta_{TH}$ (NO in step ST1), the controller 30 terminates this turn of the discharge rate reduction start determining process without decreasing a discharge rate of the main pump 12. This is because, even if the operator has stopped the working boom 4, a body stability degree of the hydraulic shovel does not become lower than or equal to the predetermined level.

In contrast, if the controller 30 determines that the boom angle $\alpha$ is greater than or equal to the threshold value $\alpha_{TH}$ and the arm angle $\beta$ is greater than or equal to the threshold value $\beta_{TH}$ (YES in step ST1), the controller 30 determines whether the boom manipulating lever 16A has been returned toward a direction of a neutral position (step ST2). Specifically, the body stability determining part 300 in the controller 30 determines whether the boom manipulating lever 16A, which had been manipulated toward a direction of lever manipulation for lifting or lowering the boom 4, has been returned toward the direction of the neutral position.

If the controller 30 determines that the boom manipulating lever 16A has not been returned toward the direction of the neutral position (NO in step ST2), the controller 30 terminates this turn of the discharge rate reduction start determining process without decreasing a discharge rate of the main pump 12. This is because the operator is in the middle of accelerating the boom 4 or operating the boom 4 at constant speed and thus a posture of the hydraulic shovel is relatively stable.

In contrast, if the controller 30 determines that the boom manipulating lever 16A has been returned toward the direction of the neutral position (YES in step ST2), the discharge rate controlling part 301 in the controller 30 outputs a control signal to the regulator 13 so as to decrease a discharge rate of the main pump 12 (step ST3). This is to prevent a return action at the time of stopping the boom 4 from being large by slowing down a movement of the boom 4 before stopping the boom 4.

Specifically, the discharge rate controlling part 301 outputs a control signal to the regulator 13, adjusts the regulator 13, and thus decreases a discharge rate of the main pump 12. Thus, the discharge rate controlling part 301 can decrease a horsepower of the main pump 12 by decreasing a discharge rate Q of the main pump 12.

In this way, the controller 30 decreases a discharge rate of the main pump 12 and slows down a movement of the decelerating boom 4. Thus, the controller 30 can reduce a return action at the time of stopping the boom 4 and can improve a body stability degree of the hydraulic shovel.

Also, the controller 30 decreases a load on the engine 11 by decreasing a discharge rate of the main pump 12 so as to allow an output of the engine 11 to be used for purposes other than a purpose for driving the main pump 12. Thus, the controller 30 can improve energy efficiency of the hydraulic shovel.

Figure 6:
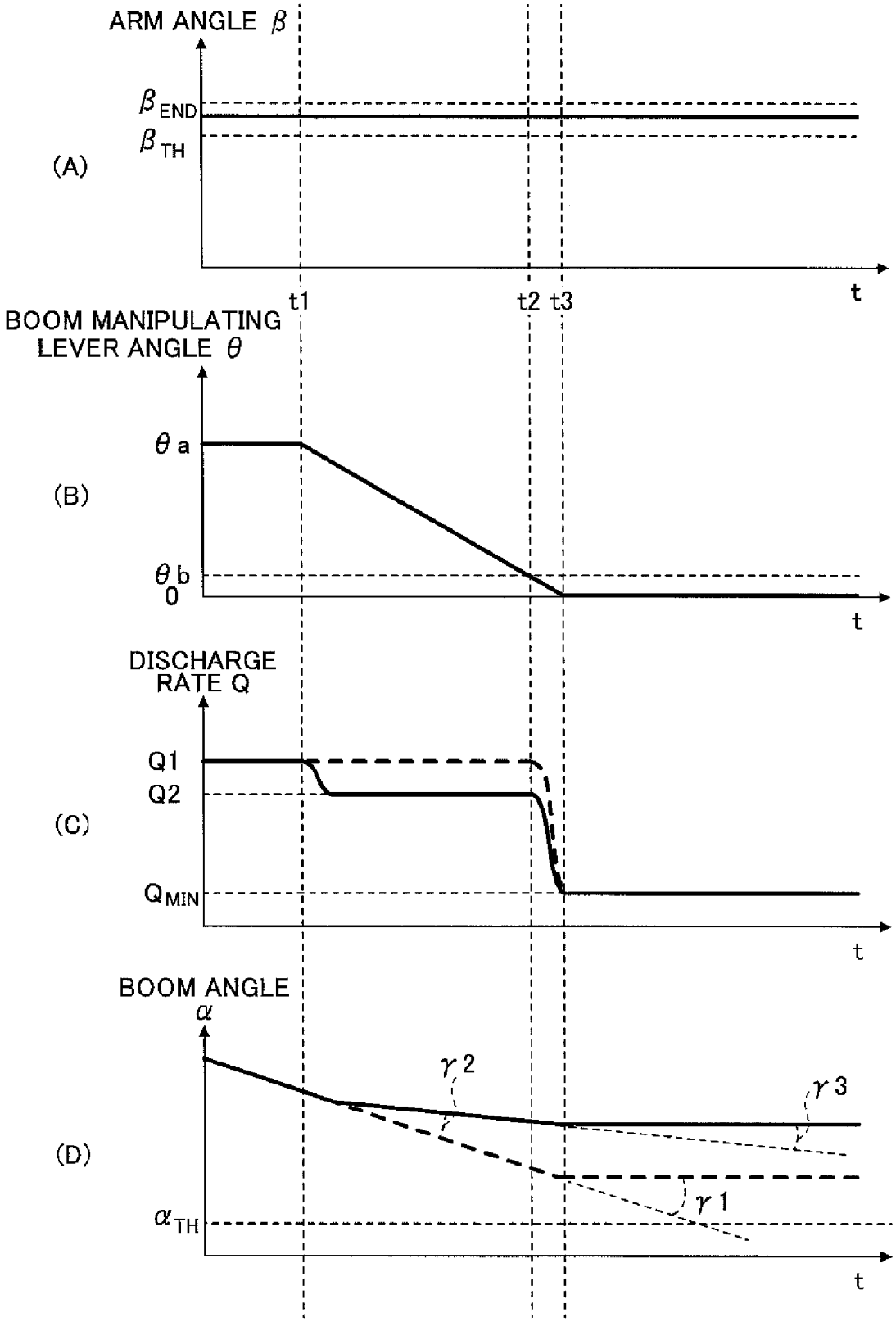
FIG. 6 is a first diagram showing changes in an arm angle, a boom manipulating lever angle, a discharge rate, and a boom angle during stopping a downward boom.

FIG. 6 is a diagram showing temporal changes in an arm angle $\beta$, a boom manipulating lever angle $\theta$, a discharge rate Q of the main pump 12, and a boom angle $\alpha$ in a case where the controller 30 decreases the discharge rate Q of the main pump 12.

FIG. 6(A) shows a change in the arm angle $\beta$, and FIG. 6(B) shows a change in the boom manipulating lever angle $\theta$. Also, a range from a neutral position 0 to a first bounding angle $\theta b$ in FIG. 6(B) is a dead band range. In the dead band range, even if the boom manipulating lever 16A has been manipulated, the boom 4 does not move and the discharge rate Q of the main pump 12 does not increase, either. A range from an angle $\theta a$ to the first bounding angle $\theta b$ in FIG. 6(B) is a normal operation range. In the normal operation range, the boom 4 moves in response to the boom manipulating lever 16A.

In FIG. 6(C), a solid line indicates a change in the discharge rate Q of the main pump 12 in a case where the discharge rate Q is controlled at a discharge rate decreased state, and a dashed line indicates a change in the discharge rate Q of the main pump 12 in a case where the discharge rate Q is not controlled at a discharge rate decreased state. A discharge rate Q1 indicates a discharge rate at a normal operating state. In the first embodiment, the discharge rate Q1 is a maximum discharge rate. Also, a discharge rate Q2 indicates a discharge rate at a discharge rate decreased state.

In FIG. 6(D), a solid line indicates a change in the boom angle $\alpha$ in a case where the discharge rate Q is controlled at a discharge rate decreased state, and a dashed line indicates a change in the boom angle $\alpha$ in a case where the discharge rate Q is not controlled at a discharge rate decreased state.

At a time point 0, the arm angle $\beta$ is already close to the maximum angle $\beta_{END}$ above the threshold value $\beta_{TH}$, the hydraulic shovel is at a state where the arm 5 is opened widely. At this state, an operator is tilting the boom manipulating lever 16A toward a direction for lowering the boom 4 to a maximum extent. Thus, the boom manipulating lever angle $\theta$ is at a maximum angle $\theta a$.

From the time point 0 to a time point t1, the operator is tilting the boom manipulating lever 16A toward a direction for lowering the boom 4 to a maximum extent. Thus, the boom angle $\alpha$ decreases as time goes by. At this time, the discharge rate Q of the main pump 12 is at the maximum discharge rate Q1. If the discharge rate Q is not controlled at a discharge rate decreased state, even if the operator has started to return the boom manipulating lever 16A from the maximum angle $\theta a$ toward the direction of the neutral position 0 at the time point t1, the discharge rate Q of the maim pump 12 remains unchanged and the main pump 12 continues to discharge at the maximum discharge rate Q1. Thus, the boom angle $\alpha$ continues to decrease at the same angular rate as an angular rate between the time point 0 and the time point t1.

Then, at a time point t2, if the boom manipulating lever angle $\theta$ exceeds the first bounding angle $\theta b$ and enters into the dead band range, the discharge rate Q of the main pump 12 decreases rapidly and reaches a minimum discharge rate $Q_{MIN}$ at a time point t3. In this way, the discharge rate Q of the main pump 12 rapidly decreases to the minimum discharge rate $Q_{MIN}$. Thus, the boom 4, which has been descending at constant angular rate, comes to a sudden stop at the time point t3.

If the discharge rate Q is controlled at a discharge rate decreased state, when the operator has started to return the boom manipulating lever 16A from the maximum angle θa toward the direction of the neutral position 0 at the time point t1, the discharge rate controlling part 301 outputs a control signal to the regulator 13. Thus, the regulator 13 is adjusted and the discharge rate Q of the main pump 12 is decreased from the discharge rate Q1 to the discharge rate Q2 at a discharge rate decreased state. With a decrease in the discharge rate Q of the main pump 12, the boom 4, which has been descending at constant angular rate, continues to descend at a lower angular rate.

Then, at the time point t2, if the boom manipulating lever angle θ enters into the dead band range, the discharge rate Q of the main pump 12 decreases from the discharge rate Q2 at a discharge rate decreased state to the minimum discharge rate $Q_{MIN}$. That is, a horsepower of the main pump 12 decreases. Thus, an angular rate of the boom 4 becomes zero and the descent of the boom 4 stops.

In this way, if the discharge rate Q is not controlled at a discharge rate decreased state, an amount of change in an angular rate of the boom 4 takes a large value of γ1 at the time point t3. However, if the discharge rate Q is controlled at a discharge rate decreased state, it is changed to γ2 and then to γ3 in a stepwise fashion. Thus, if the discharge rate Q is controlled at a discharge rate decreased state, the boom 4 can stop smoothly without generating a large vibration.

Also, changes shown in FIG. 6(A)-6(D) are applicable to a case of stopping the ascending boom 4. In that case, plus and minus of the boom manipulating lever angle θ (see FIG. 6(B)) are reversed, and a decreasing rate of the boom angle α (see FIG. 6(D)) is read as an increasing rate.

Also, in the first embodiment, even if the controller 30 determines that the boom angle α is greater than or equal to the threshold value $\alpha_{TH}$, that the arm angle β is greater than or equal to the threshold value $\beta_{TH}$, and that the boom manipulating lever 16A has been returned toward the direction of the neutral position, if the controller 30 determines that it is during excavation, the controller 30 may cancel a reduction of a discharge rate. This is to prevent a movement of the attachment from slowing down during excavation. Also, the determination whether it is during excavation is conducted, for example, based on an output of the boom cylinder pressure sensor 18*a*, the discharge pressure sensor 18*b*, a stroke sensor (not shown) which detects a stroke amount of the boom cylinder 7, or the like.

Conversely, even if the boom angle α is lower than the threshold value $\alpha_{TH}$, if the controller 30 determines that it is not during excavation, the controller 30 may decrease a discharge rate of the main pump 12 when the controller 30 determines that the arm angle β is greater than or equal to the threshold value $\beta_{TH}$, and that the boom manipulating lever 16A has been returned toward the direction of the neutral position.

According to the above configuration, the hydraulic shovel according to the first embodiment decreases a discharge rate of the main pump 12 by adjusting the regulator 13 if it determines that a body stability degree of the hydraulic shovel in a case of stopping the boom 4 while keeping the arm 5 wide open becomes lower than or equal to a predetermined level. As a result, the hydraulic shovel can stop the boom 4 while slowing down a movement of the boom 4 in a stepwise fashion, and thus can improve a body stability degree of the hydraulic shovel at the time of stopping the boom 4.

Also, the hydraulic shovel according to the first embodiment decreases a load on the engine 11 by decreasing a discharge rate of the main pump 12 so as to allow an output of the engine 11 to be used for other purposes. Thus, the hydraulic shovel can improve energy efficiency.

Also, the hydraulic shovel according to the first embodiment decreases a discharge rate of the main pump 12 by adjusting the regulator 13. Thus, the hydraulic shovel can easily and reliably improve a body stability degree and energy efficiency of the hydraulic shovel in a case of stopping the boom 4.

Second Embodiment

Next, referring to FIGS. 7 and 8, there will be explained about a hydraulic shovel according to a second embodiment.

In the hydraulic shovel according to the second embodiment, the discharge rate controlling part 301 in the controller 30 outputs a control signal to the engine 11, as needed, so as to decrease a rotational speed of the engine 11 (e.g., so as to decrease a rotational speed of the engine 11 rotating at 1800 rpm by 100-200 rpm). As a result, the hydraulic shovel according to the second embodiment can decrease a rotational speed of the main pump 12 and thus can decrease a discharge rate of the main pump 12.

In this way, the hydraulic shovel according to the second embodiment differs from the hydraulic shovel according to the first embodiment which decreases a discharge rate of the main pump 12 by adjusting the regulator 13 in that the hydraulic shovel according to the second embodiment decreases a discharge rate of the main pump 12 by decreasing a rotational speed of the engine 11. Otherwise, both are common.

Thus, there will be explained about the differences in detail while omitting an explanation of the common points. Also, the same reference numbers as those used for explaining the hydraulic shovel according to the first embodiment are used.

Figure 7:
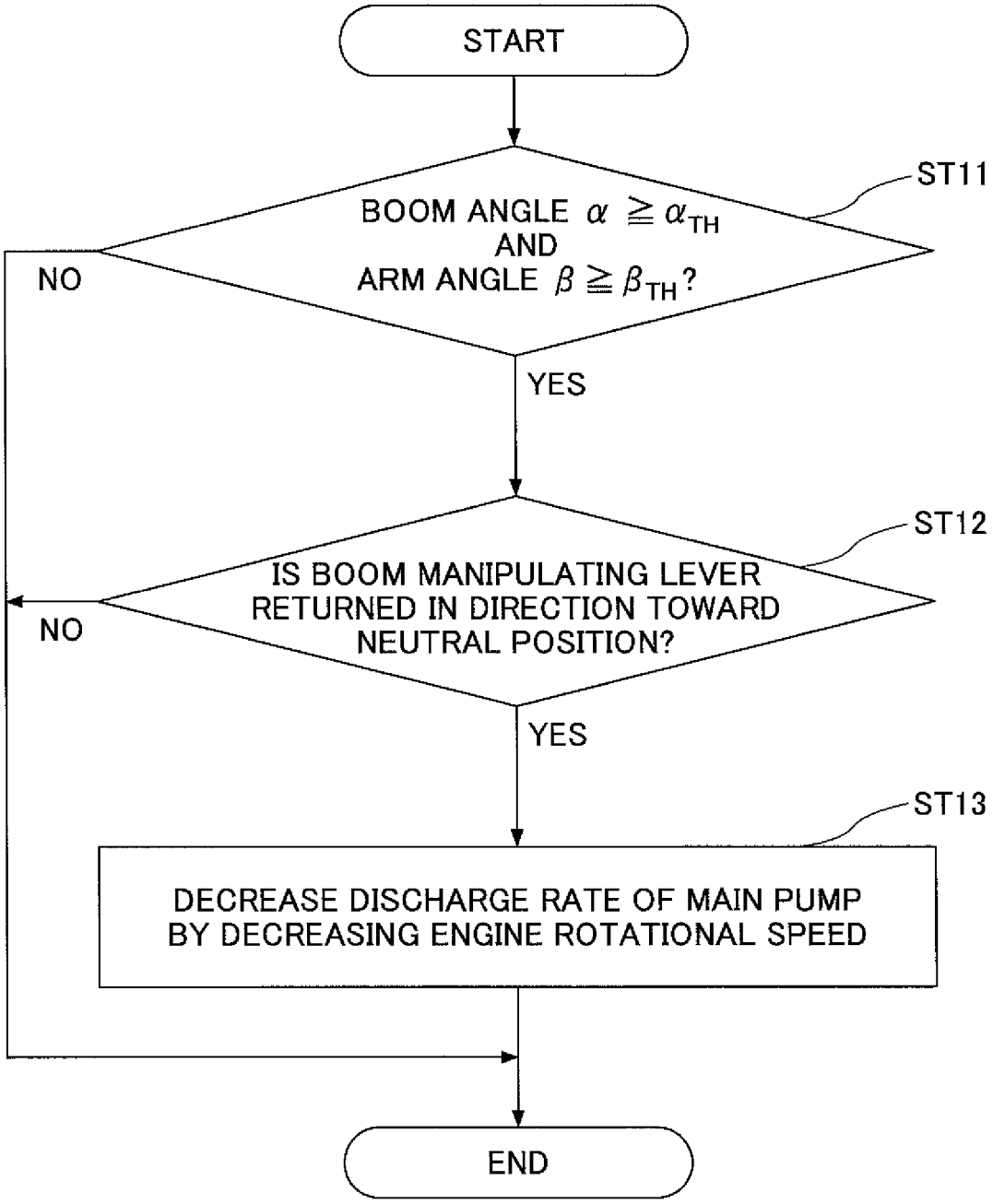
FIG. 7 is a second flowchart showing a flow of the discharge rate reduction start determining process.

FIG. 7 is a flowchart showing a flow of a discharge rate reduction start determining process in the hydraulic shovel according to the second embodiment.

FIG. 7 is characterized in that a procedure for decreasing a discharge rate of the main pump 12 in step ST13 is achieved by decreasing an engine rotational speed, and in that the procedure is different from a procedure achieved by adjusting the regulator 13 in step ST5 in FIG. 5.

Specifically, the body stability determining part 300 in the controller 30 determines whether the boom angle α is greater than or equal to the threshold value $\alpha_{TH}$ and the arm angle β is greater than or equal to the threshold value $\beta_{TH}$ (step ST11).

If it is determined that the boom angle α is greater than or equal to the threshold value $\alpha_{TH}$ and the arm angle β is greater than or equal to the threshold value $\beta_{TH}$ (YES in step ST11), the body stability determining part 300 in the controller 30 determines whether the boom manipulating lever 16A has been returned toward a direction of a neutral position (step ST12).

If it is determined that the boom manipulating lever 16A has been returned toward a direction of a neutral position (YES in step ST12), the discharge rate controlling part 301 in the controller 30 outputs a control signal to the engine 11 so as to decrease an engine rotational speed and to decrease a discharge rate of the main pump 12 (step ST13). In this way, the controller 30 can decrease a horsepower of the main pump 12 by decreasing a discharge rate Q of the main pump 12.

Figure 8:
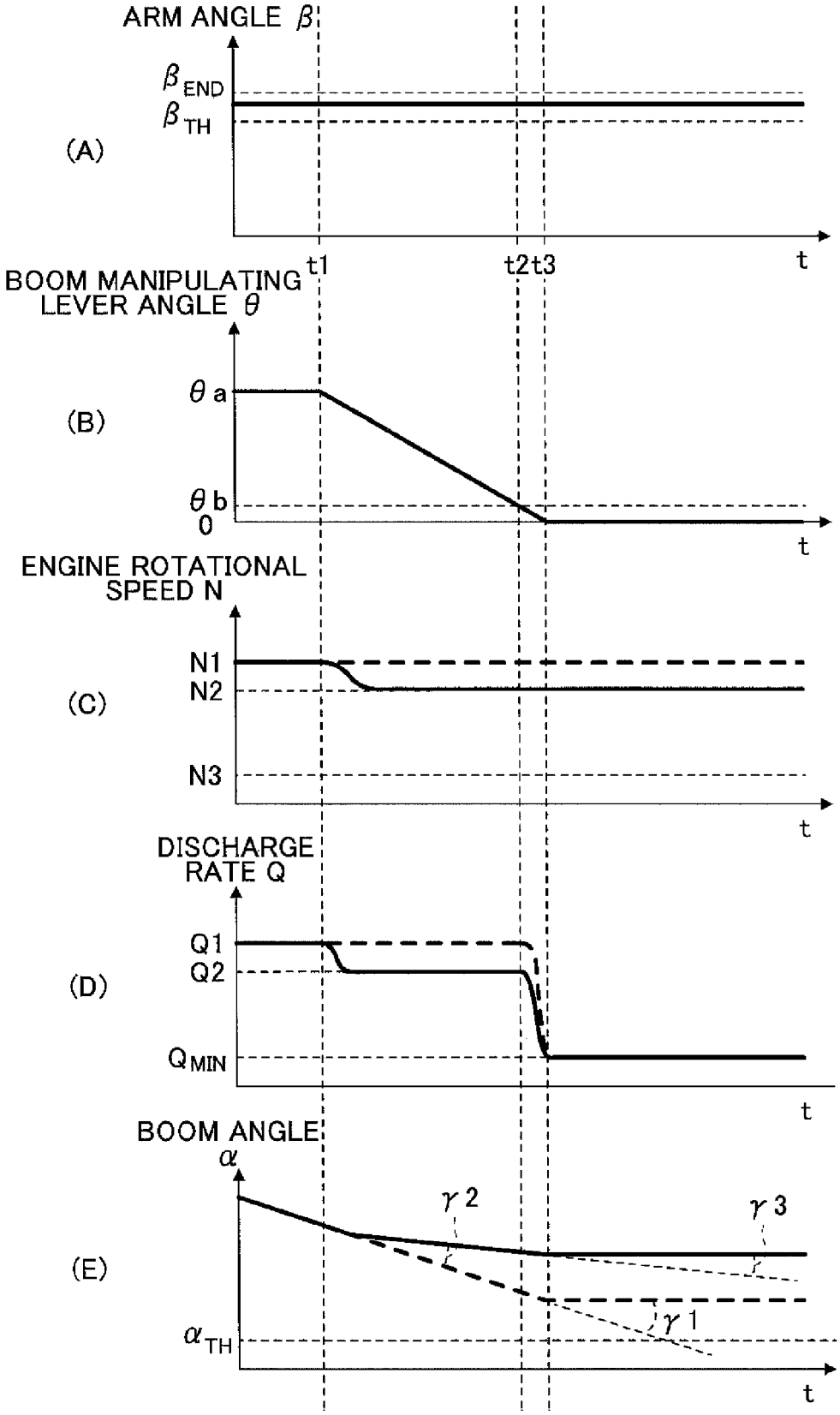
FIG. 8 is a second diagram showing changes in an arm angle, a boom manipulating lever angle, a discharge rate, and a boom angle during stopping a downward boom.

As is the case in FIG. 6, FIG. 8 shows temporal changes in an arm angle β, a boom manipulating lever angle θ, a discharge rate Q of the main pump 12, and a boom angle α in a case that the controller 30 decreases the discharge rate Q of the main pump 12. Also, it additionally shows a temporal change in an engine rotational speed N at FIG. 8(C). An engine rotational speed N1 corresponds to an engine rotational speed at a normal state, and an engine rotational speed N2 corresponds to an engine rotational speed at a discharge rate decreased state.

At FIGS. 8(C), 8(D), and 8(E), solid lines show changes in the engine rotational speed N, the discharge rate Q of the main pump 12, and the boom angle α in a case where the discharge rate Q is controlled at a discharge rate decreased state, and dashed lines show changes in the engine rotational speed N, the discharge rate Q of the main pump 12, and the boom angle α in a case where the discharge rate Q is not controlled at a discharge rate decreased state.

At the time point 0, the arm angle β is already close to the maximum angle $\beta_{END}$ above the threshold value $\beta_{TH}$, the hydraulic shovel is at a state where the arm 5 is opened widely. At this state, an operator is tilting the boom manipulating lever 16A toward a direction for lowering the boom 4 to a maximum extent. Thus, the boom manipulating lever angle θ is at a maximum angle θa.

From the time point 0 to a time point t1, the operator is tilting the boom manipulating lever 16A toward a direction for lowering the boom 4 to a maximum extent. Thus, the boom angle α decreases as time goes by. At this time, the rotational speed N of the engine 11 corresponds to the engine rotational speed N1 at a normal state, and the discharge rate Q of the main pump 12 is at the maximum discharge rate Q1. If the discharge rate Q is not controlled at a discharge rate decreased state, even if the operator has started to return the boom manipulating lever 16A from the maximum angle θa toward the direction of the neutral position 0 at the time point t1, the rotational speed N of the engine 11 continues to rotate at the rotational speed N1 at a normal state. Thus, the discharge rate Q of the maim pump 12 remains unchanged and the main pump 12 continues to discharge at the maximum discharge rate Q1. Thus, the boom angle α continues to decrease at the same angular rate as an angular rate between the time point 0 and the time point t1.

Then, at a time point t2, if the boom manipulating lever angle θ exceeds the first bounding angle θb and enters into the dead band range, due to an adjustment of the regulator 13, the discharge rate Q of the main pump 12 decreases rapidly and reaches a minimum discharge rate $Q_{MIN}$ at a time point t3. In this way, the discharge rate Q of the main pump 12 rapidly decreases to the minimum discharge rate $Q_{MIN}$. Thus, the boom 4, which has been descending at constant angular rate, comes to a sudden stop at the time point t3.

If the discharge rate Q is controlled at a discharge rate decreased state, when the operator has started to return the boom manipulating lever 16A from the maximum angle θa toward the direction of the neutral position 0 at the time point t1, the discharge rate controlling part 301 outputs a control signal to the engine 11. Thus, the engine rotational speed N decreases to the rotational speed N2 set for a discharge rate decreased state. With a decrease in the engine rotational speed N, the discharge rate Q of the main pump 12 decreases from the discharge rate Q1 to the discharge rate Q2 at a discharge rate decreased state. Also, the boom 4, which has been descending at constant angular rate, continues to descend at a lower angular rate.

Then, at the time point t2, if the boom manipulating lever angle θ enters into the dead band range, due to an adjustment of the regulator 13, the discharge rate Q of the main pump 12 decreases from the discharge rate Q2 at a discharge rate decreased state to the minimum discharge rate $Q_{MIN}$. That is, a horsepower of the main pump 12 decreases. Thus, an angular rate of the boom 4 becomes zero and the descent of the boom 4 stops.

In this way, if the discharge rate Q is not controlled at a discharge rate decreased state, an amount of change in an angular rate of the boom 4 takes a large value of γ1 at the time point t3. However, if the discharge rate Q is controlled at a discharge rate decreased state, it is changed to γ2 and then to γ3 in a stepwise fashion. Thus, if the discharge rate Q is controlled at a discharge rate decreased state, the boom 4 can stop smoothly without generating a large vibration.

According to the above configuration, the hydraulic shovel according to the second embodiment can achieve effects similar to the above effects achieved by the hydraulic shovel according to the first embodiment.

Also, the hydraulic shovel according to the second embodiment decreases the discharge rate of the main pump 12 by decreasing the rotational speed of the engine 11. Thus, the hydraulic shovel can easily and reliably improve a body stability degree and energy efficiency of the hydraulic shovel in a case of stopping the boom 4.

Next, referring to FIGS. 9 and 10, there will be explained about a hydraulic shovel according to a third embodiment of the present invention.

The hydraulic shovel according to the third embodiment differs from the hydraulic shovel according to the first embodiment in that the hydraulic shovel according to the third embodiment changes a discharge rate of the main pump 12 through using a negative control regulation. Otherwise, both are common.

Thus, there will be explained about the differences in detail while omitting an explanation of the common points. Also, the same reference numbers as those used for explaining the hydraulic shovel according to the first embodiment are used.

Figure 9:
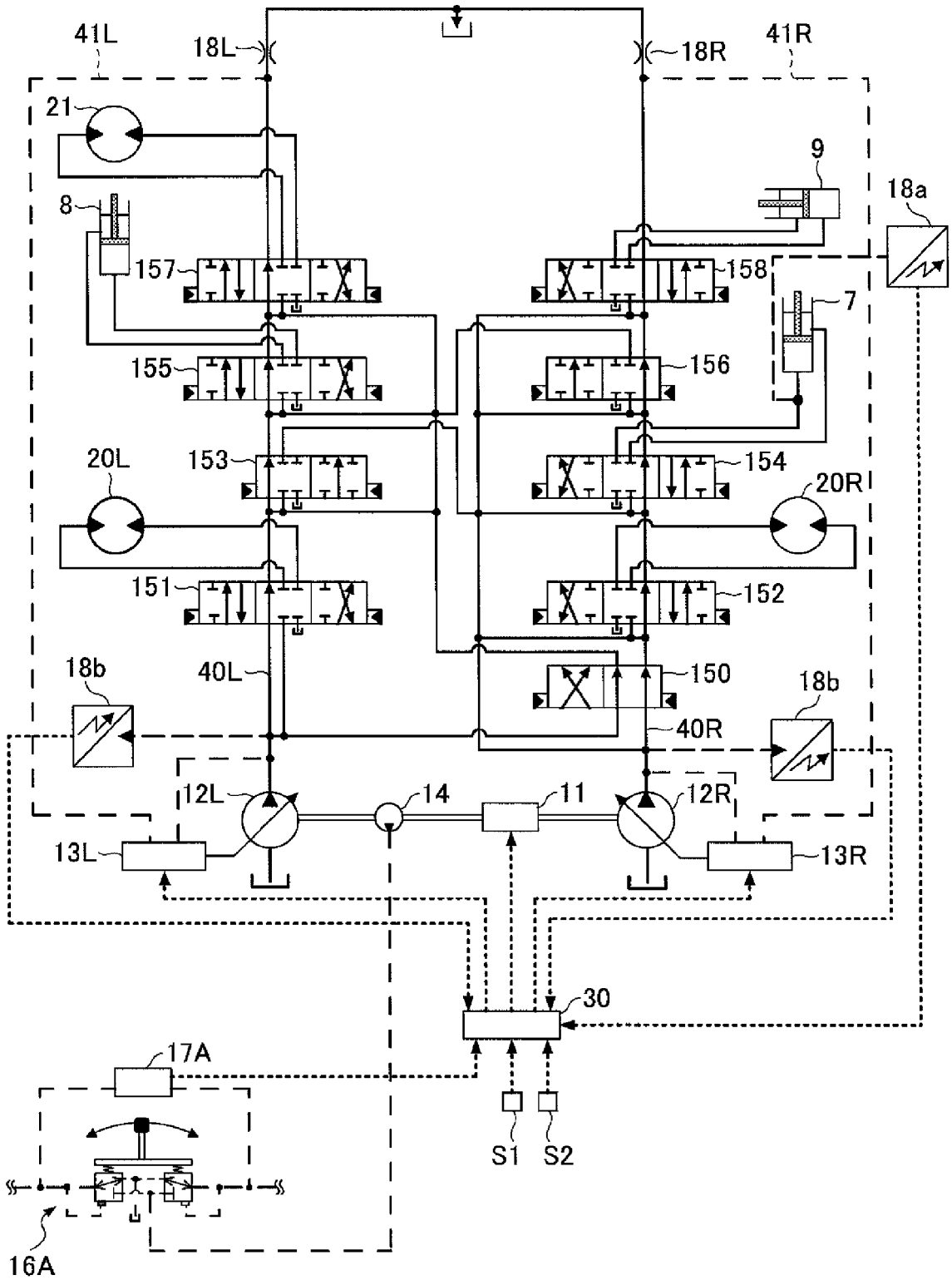
FIG. 9 is a second schematic diagram showing a configuration example of a hydraulic system installed in the hydraulic shovel.

FIG. 9 is a schematic diagram showing a configuration example of the hydraulic system installed in the hydraulic shovel according to the third embodiment. As is the case in FIGS. 2 and 3, in FIG. 9, a mechanical power system, a high pressure hydraulic line, a pilot line, and an electric drive/control system are indicated by a double line, a solid line, a dashed line, and a dotted line, respectively. Also, the hydraulic system in FIG. 9 differs from the hydraulic system shown in FIG. 3 in that the hydraulic system in FIG. 9 has negative control throttles 18L, 18R and negative control pressure hydraulic lines 41L, 41R. Otherwise, both are common.

The negative control throttles 18L, 18R are arranged between each of the flow control valves 157, 158 at the most downstream part of the center bypass hydraulic lines 40L, 40R and the hydraulic oil tank. Flows of hydraulic oil discharged from the main pumps 12L, 12R are restricted by the negative control throttles 18L, 18R. In this way, the negative control throttles 18L, 18R create a control pressure (hereinafter referred to as a "negative control pressure") for controlling the regulators 13L, 13R.

The negative control pressure hydraulic lines 41L, 41R indicated by dashed lines are pilot lines configured to transmit the negative control pressure created upstream of the negative control throttles 18L, 18R to the regulators 13L, 13R.

The regulators 13L, 13R regulate discharge rates of the main pumps 12L, 12R by adjusting swash plate tilt angles of the main pumps 12L, 12R depending on the negative control pressure (hereinafter, this regulation is referred to as a "negative control regulation"). Also, the regulators 13L, 13R decrease discharge rates of the main pumps 12L, 12R with an increase in the negative control pressure to be transmitted, and increase discharge rates of the main pumps 12L, 12R with a decrease in the negative control pressure to be transmitted.

Specifically, as shown in FIG. 9, if any one of the hydraulic actuators in the hydraulic shovel has not been operated (hereinafter this case is referred to as a "standby mode"), the hydraulic oil discharged from the main pumps 12L, 12R reaches the negative control throttles 18L, 18R through the center bypass hydraulic lines 40L, 40R. Then, flows of the hydraulic oil discharged from the main pumps 12L, 12R increase negative control pressure created upstream of the negative control throttles 18L, 18R. As a result, the regulators 13L, 13R decrease the discharge rates of the main pumps 12L, 12R to the minimum allowable discharge rate (e.g., 50 liters per minute), and thus reduce a pressure loss (a pumping loss) when the discharged hydraulic oil passes through the center bypass hydraulic lines 40L, 40R.

In contrast, if any one of the hydraulic actuators in the hydraulic shovel has been operated, the hydraulic oil discharged from the main pumps 12L, 12R flows into a hydraulic actuator to be operated via a flow control valve corresponding to the hydraulic actuator to be operated. Then, flows of the hydraulic oil discharged from the main pumps 12L, 12R decrease or eliminate an amount of hydraulic oil which reaches the negative control throttles 18L, 18R, and thus decrease the negative control pressure created upstream of the negative control throttles 18L, 18R. As a result, the regulators 13L, 13R receiving the decreased negative control pressure increase the discharge rate of the main pump 12L, 12R, circulate sufficient hydraulic oil to the hydraulic actuator to be operated, and thus ensure an operation of the hydraulic actuator to be operated.

According to the above configuration, the hydraulic system in FIG. 9 can reduce unnecessary energy consumption in the main pumps 12L, 12R (a pumping loss in the center bypass hydraulic lines 40L, 40R caused by the hydraulic oil discharged from the main pumps 12L, 12R) at the standby mode.

Also, if the hydraulic system in FIG. 9 operates a hydraulic actuator, the hydraulic system allows the main pumps 12L, 12R to reliably supply a necessary and sufficient hydraulic oil to the hydraulic actuator to be operated.

Figure 10:
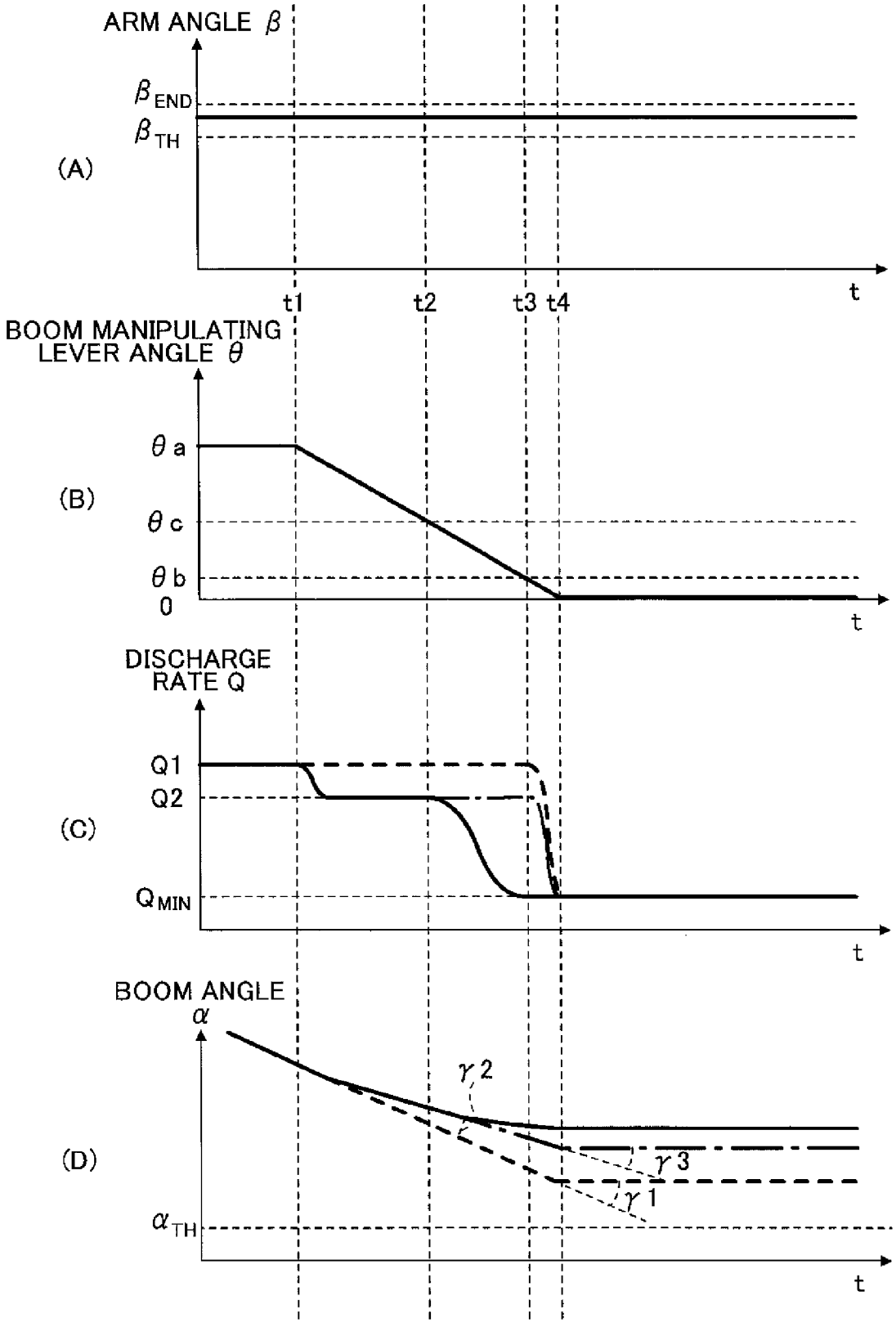
FIG. 10 is a third diagram showing changes in an arm angle, a boom manipulating lever angle, a discharge rate, and a boom angle during stopping a downward boom.

As is the case in FIG. 6, FIG. 10 shows temporal changes in an arm angle β, a boom manipulating lever angle θ, a discharge rate Q of the main pump 12, and a boom angle α in a case where the controller 30 decreases the discharge rate Q of the main pump 12.

At FIGS. 10(C) and 10(D), solid lines show changes in the discharge rate Q of the main pump 12 and the boom angle α in a case where the discharge rate Q is controlled under the negative control regulation after having been controlled at a discharge rate decreased state, and dashed-dotted lines show changes in the discharge rate Q of the main pump 12 and the boom angle α in a case where the discharge rate Q is not controlled under the negative control regulation after having been controlled at a discharge rate decreased state. Also, a range from a neutral position 0 to a first bounding angle θb in FIG. 10(B) is a dead band range, and a range from the first bounding angle θb to a second bounding angle θc in FIG. 10(B) is a negative control regulation range where the negative control regulation is performed.

At a time point 0, as is the case in FIG. 6, the arm angle θ is already close to the maximum angle $\beta_{END}$ above the threshold value $\beta_{TH}$, the hydraulic shovel is at a state where the arm 5 is opened widely. At this state, an operator is tilting the boom manipulating lever 16A toward a direction for lowering the boom 4 to a maximum extent. Thus, the boom manipulating lever angle θ is at a maximum angle θa.

From the time point 0 to a time point t1, the operator is tilting the boom manipulating lever 16A toward a direction for lowering the boom 4 to a maximum extent. Thus, the boom angle α decreases as time goes by. At this time, the discharge rate Q of the main pump 12 is at the maximum discharge rate Q1.

If the discharge rate Q is controlled at a discharge rate decreased state, when the operator has started to return the boom manipulating lever 16A from the maximum angle θa toward the direction of the neutral position 0 at the time point t1, the discharge rate controlling part 301 outputs a control signal to the regulator 13. Thus, the regulator 13 is adjusted, the discharge rate Q of the main pump 12 is decreased from the discharge rate Q1 to the discharge rate Q2 at a discharge rate decreased state, and a horsepower of the main pump 12 decreases. Thus, the boom 4, which has been descending at constant angular rate, continues to descend at an angular rate decreased by γ2, with a decrease in the discharge rate Q of the main pump 12.

In a case where the negative control regulation is not performed, as indicated by a dashed-dotted line, even if the boom manipulating lever angle θ has become lower than the second bounding angle θc at the time point t2, the discharge rate Q of the main pump 12 remains unchanged, and the main pump 12 continues to discharge at the discharge rate Q2 set for a discharge rate decreased state. Thus, the boom angle α continues to decrease at the same angular rate as an angular rate between the time point t1 and the time point t2.

Then, at a time point t3, if the boom manipulating lever angle θ exceeds the first bounding angle θb and enters into the dead band range, the discharge rate Q of the main pump 12 decreases to a minimum discharge rate $Q_{MIN}$. In this way, the discharge rate Q of the main pump 12 decreases to the minimum discharge rate $Q_{MIN}$. Thus, the boom 4, which has been descending at constant angular rate, stops at the time point t3. At this time, an amount of change in the angular rate of the boom 4 is γ3.

After the discharge rate Q has been controlled at a discharge rate decreased state, if the negative control regulation is supposed to be performed, as indicated by a solid line, when the boom manipulating lever angle θ becomes lower than the second bounding angle θc at the time point t2, the negative control regulation is performed. As a result, the discharge rate Q decreases according to the negative control pressure which gradually increases as the boom manipulating lever 16A is returned toward a direction of the neutral position. The boom 4, which has been descending at constant angular rate, continues to descend at a lower angular rate, with a decrease in the discharge rate Q of the main pump 12.

Then, at a time point t3, if the boom manipulating lever angle θ enters into the dead band range, the discharge rate Q of the main pump 12 becomes the minimum discharge rate $Q_{MIN}$. That is, a horsepower of the main pump 12 decreases. Thus, an angular rate of the boom 4 becomes zero and the descent of the boom 4 stops.

In this way, if the negative control regulation is performed after the discharge rate Q has been controlled at a discharge rate decreased state, the discharge rate Q of the main pump 12 gradually decreases with an increase in the negative control pressure after the time point t2. Thus, an angular rate of the boom 4 gradually decreases. As a result, in comparison to a case where the negative control regulation is not performed, it is possible to reduce a vibration of the boom 4 and to stop the boom 4 smoothly.

Also, changes shown in FIG. 10(A)-(D) are applicable to a case of stopping the ascending boom 4. In that case, plus and minus of the boom manipulating lever angle θ (see FIG. 10(B)) are reversed, and a decreasing rate of the boom angle α (see FIG. 10(D)) is read as an increasing rate.

Also, in the third embodiment, even if the controller 30 determines that the boom angle α is greater than or equal to the threshold value $\alpha_{TH}$, that the arm angle β is greater than or equal to the threshold value $\beta_{TH}$, and that the boom manipulating lever 16A has been returned toward the direction of the neutral position, if the controller 30 determines that it is during excavation, the controller 30 may cancel a reduction of a discharge rate. This is to prevent a movement of the attachment from slowing down during excavation. Also, the determination whether it is during excavation is conducted, for example, based on an output of the boom cylinder pressure sensor 18*a*, the discharge pressure sensor 18*b*, a stroke sensor (not shown) which detects a stroke amount of the boom cylinder 7, or the like.

Conversely, even if the boom angle $\alpha$ is lower than the threshold value $\alpha_{TH}$, if the controller 30 determines that it is not during excavation, the controller 30 may decrease a discharge rate of the main pump 12 when the controller 30 determines that the arm angle $\beta$ is greater than or equal to the threshold value $\beta_{TH}$, and that the boom manipulating lever 16A has been returned toward the direction of the neutral position.

According to the above configuration, the hydraulic shovel according to the third embodiment decreases a discharge rate of the main pump 12 by adjusting the regulator 13 if it determines that a body stability degree of the hydraulic shovel in a case of stopping the boom 4 while keeping the arm 5 wide open becomes lower than or equal to a predetermined level. Then, the hydraulic shovel according to the third embodiment further decreases a discharge rate of the main pump 12 by getting the negative control regulation started when the boom manipulating lever angle $\theta$ has entered into the negative control regulation range. As a result, the hydraulic shovel according to the third embodiment can stop the boom 4 while slowing down a movement of the boom 4 in a stepwise fashion, and thus can improve a body stability degree of the hydraulic shovel at the time of stopping the boom 4.

Also, the hydraulic shovel according to the third embodiment decreases a load on the engine 11 by decreasing a discharge rate of the main pump 12 so as to allow an output of the engine 11 to be used for other purposes. Thus, the hydraulic shovel can improve energy efficiency.

Also, the hydraulic shovel according to the third embodiment decreases a discharge rate of the main pump 12 by adjusting the regulator 13. Thus, the hydraulic shovel can easily and reliably improve a body stability degree and energy efficiency of the hydraulic shovel in a case of stopping the boom 4.

Fourth Embodiment

Next, referring to FIG. 11, there will be explained about a hydraulic shovel according to a fourth embodiment of the present invention.

In the hydraulic shovel according to the fourth embodiment, the discharge rate controlling part 301 in the controller 30 outputs a control signal to the engine 11, as needed, so as to decrease a rotational speed of the engine 11 (e.g., so as to decrease a rotational speed of the engine 11 rotating at 1800 rpm by 100-200 rpm). As a result, the hydraulic shovel according to the fourth embodiment can decrease a rotational speed of the main pump 12 and thus can decrease a discharge rate of the main pump 12.

In this way, the hydraulic shovel according to the fourth embodiment differs from the hydraulic shovel according to the third embodiment which decreases a discharge rate of the main pump 12 by adjusting the regulator 13 in that the hydraulic shovel according to the fourth embodiment decreases a discharge rate of the main pump 12 by decreasing a rotational speed of the engine 11. Otherwise, both are common.

Thus, there will be explained about the differences in detail while omitting an explanation of the common points. Also, the same reference numbers as those used for explaining the hydraulic shovel according to the third embodiment are used.

Figure 11:
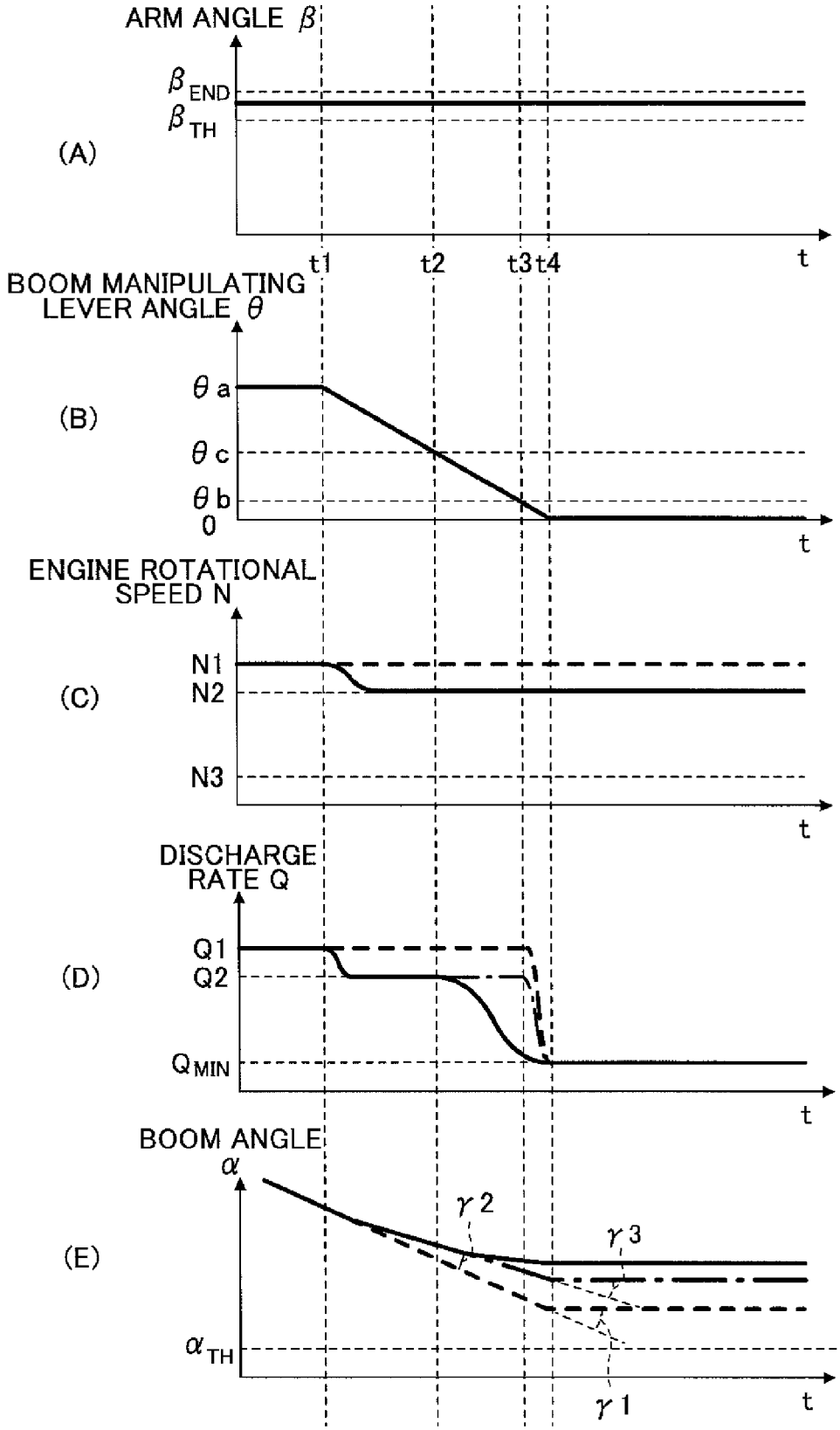
FIG. 11 is a fourth diagram showing changes in an arm angle, a boom manipulating lever angle, a discharge rate, and a boom angle during stopping a downward boom.

As is the case in FIG. 10, FIG. 11 shows temporal changes in an arm angle $\beta$, a boom manipulating lever angle $\theta$, a discharge rate Q of the main pump 12, and a boom angle $\alpha$ in a case that the controller 30 decreases the discharge rate Q of the main pump 12. Also, it additionally shows a temporal change in an engine rotational speed N at FIG. 11(C).

At FIG. 11(C), a solid line shows a change in the engine rotational speed N in a case where the discharge rate Q is controlled at a discharge rate decreased state, and a dashed line shows a change in the engine rotational speed N in a case where the discharge rate Q is not controlled at a discharge rate decreased state.

Also, at FIGS. 11(D) and 11(E), solid lines show changes in the discharge rate Q of the main pump 12 and the boom angle $\alpha$ in a case where the discharge rate Q is controlled at a discharge rate decreased state, and dashed lines show changes in the discharge rate Q of the main pump 12 and the boom angle $\alpha$ in a case where the discharge rate Q is not controlled at a discharge rate decreased state.

At the time point 0, as is the case in FIG. 10, the arm angle $\beta$ is already close to the maximum angle $\beta_{END}$ above the threshold value $\beta_{TH}$, the hydraulic shovel is at a state where the arm 5 is opened widely. At this state, an operator is tilting the boom manipulating lever 16A toward a direction for lowering the boom 4 to a maximum extent. Thus, the boom manipulating lever angle $\theta$ is at a maximum angle $\theta$a.

From the time point 0 to a time point t1, the operator is tilting the boom manipulating lever 16A toward a direction for lowering the boom 4 to a maximum extent. Thus, the boom angle $\alpha$ decreases as time goes by. At this time, the discharge rate Q of the main pump 12 is at the maximum discharge rate Q1.

If the discharge rate Q is controlled at a discharge rate decreased state, when the operator has started to return the boom manipulating lever 16A from the maximum angle $\theta$a toward the direction of the neutral position 0 at the time point t1, the discharge rate controlling part 301 outputs a control signal to the engine 11. Thus, the engine rotational speed N decreases to the rotational speed N2 set for a discharge rate decreased state. With a decrease in the engine rotational speed N, the discharge rate Q of the main pump 12 decreases from the discharge rate Q1 to the discharge rate Q2 set for a discharge rate decreased state. Also, the boom 4, which has been descending at constant angular rate, continues to descend at an angular rate decreased by $\gamma 2$.

In a case where the negative control regulation is not performed, as indicated by a dashed-dotted line, even if the boom manipulating lever angle $\theta$ has become lower than the second bounding angle $\theta$c at the time point t2, the discharge rate Q of the main pump 12 remains unchanged, and the main pump 12 continues to discharge at the discharge rate Q2 set for a discharge rate decreased state. Thus, the boom angle $\alpha$ continues to decrease at the same angular rate as an angular rate between the time point t1 and the time point t2.

Then, at a time point t3, if the boom manipulating lever angle $\theta$ exceeds the first bounding angle $\theta$b and enters into the dead band range, the discharge rate Q of the main pump 12 decreases to a minimum discharge rate $Q_{MIN}$. In this way, the discharge rate Q of the main pump 12 decreases to the minimum discharge rate $Q_{MIN}$. Thus, the boom 4, which has been descending at constant angular rate, stops at the time point t3. At this time, an amount of change in the angular rate of the boom 4 is $\gamma 3$.

After the discharge rate Q has been controlled at a discharge rate decreased state, if the negative control regulation is supposed to be performed, as is the case in FIG. 10, as indicated by a solid line, when the boom manipulating lever angle θ becomes lower than the second bounding angle θc at the time point t2, the negative control regulation is performed. As a result, the discharge rate Q decreases according to the negative control pressure which gradually increases as the boom manipulating lever 16A is returned toward a direction of the neutral position. The boom 4, which has been descending at constant angular rate, continues to descend at a lower angular rate, with a decrease in the discharge rate Q of the main pump 12.

Then, at a time point t3, if the boom manipulating lever angle θ enters into the dead band range, the discharge rate Q of the main pump 12 becomes the minimum discharge rate $Q_{MIN}$. Thus, an angular rate of the boom 4 becomes zero and the descent of the boom 4 stops.

In this way, if the negative control regulation is performed after the discharge rate Q has been controlled at a discharge rate decreased state, the discharge rate Q of the main pump 12 gradually decreases with an increase in the negative control pressure after the time point t2. Thus, an angular rate of the boom 4 gradually decreases. As a result, in comparison to a case where the negative control regulation is not performed, it is possible to reduce a vibration of the boom 4 and to stop the boom 4 smoothly.

According to the above configuration, the hydraulic shovel according to the fourth embodiment can achieve effects similar to the above effects achieved by the hydraulic shovel according to the third embodiment.

Also, the hydraulic shovel according to the fourth embodiment decreases the discharge rate of the main pump 12 by decreasing the rotational speed of the engine 11. Thus, the hydraulic shovel can easily and reliably improve a body stability degree and energy efficiency of the hydraulic shovel in a case of stopping the boom 4.

Fifth Embodiment

Next, referring to FIG. 12, there will be explained about a hybrid shovel according to a fifth embodiment of the present invention.

Figure 12:
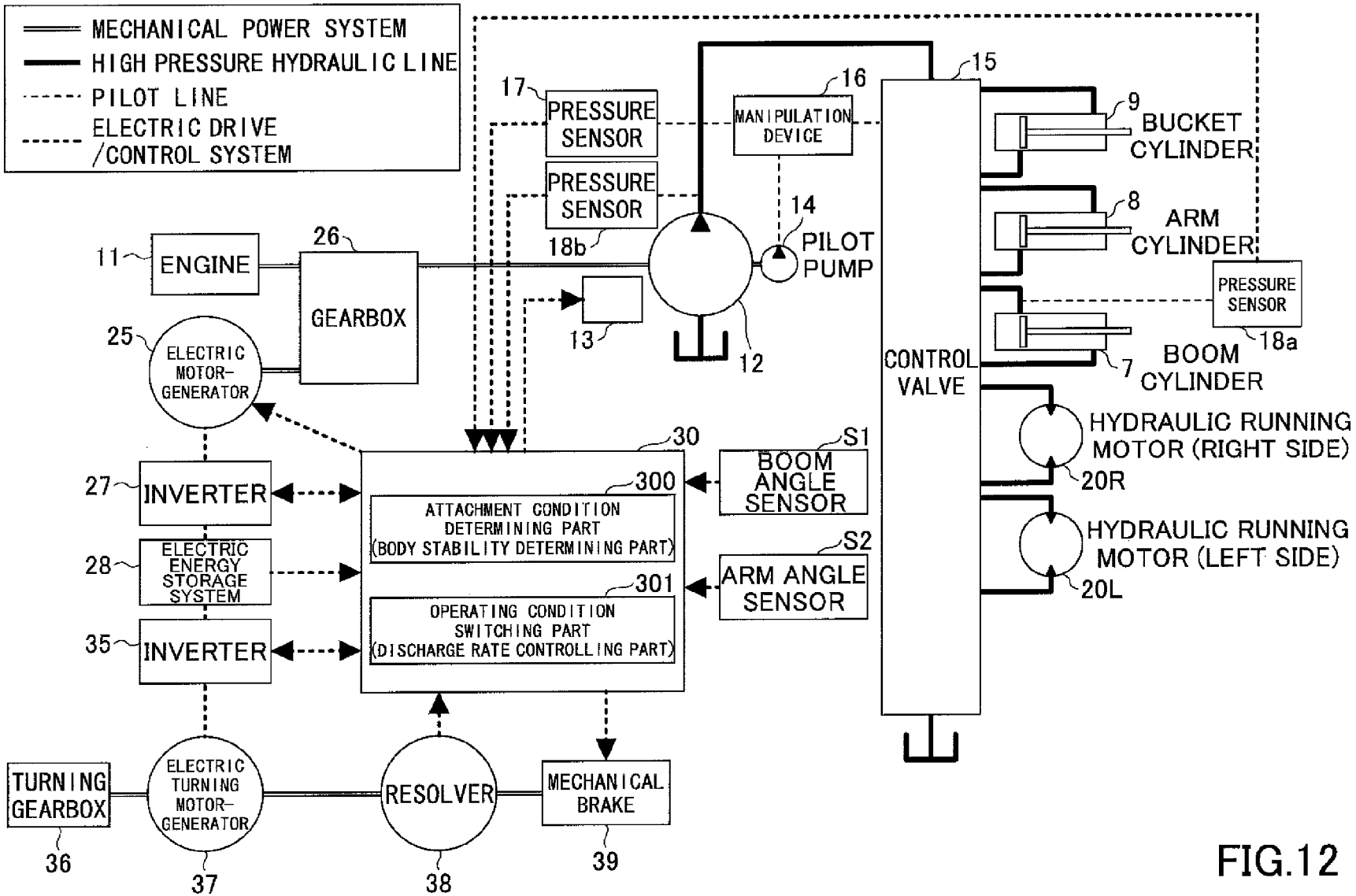
FIG. 12 is a block diagram showing a configuration example of a drive system of a hybrid shovel.

FIG. 12 is a block diagram showing a configuration example of a drive system of the hybrid shovel.

The drive system of the hybrid shovel differs from the drive system (see FIG. 2) of the hydraulic shovel according to the first embodiment in that the drive system of the hybrid shovel mainly includes an electric motor-generator 25, a gearbox 26, an inverter 27, an electric energy storage system 28, and an electric turning mechanism. Otherwise, both are common. Thus, there will be explained about the differences in detail while omitting an explanation of the common points. Also, the same reference numbers as those used for explaining the hydraulic shovel according to the first embodiment are used.

The electric motor-generator 25 is a device configured to selectively perform an electricity generating operation where it is rotated by the engine 11 and generates electricity, or an assist operation where it is rotated by an electric power stored in the electric energy storage system 28 and assists an engine output.

The gearbox 26 is a transmission mechanism configured to include two input shafts and one output shaft. One of the two input shafts is coupled to the output shaft of the engine 11, the other of the two input shafts is coupled to a rotating shaft of the electric motor-generator 25, and the one output shaft is coupled to a rotating shaft of the main pump 12.

The inverter 27 is a device configured to perform a conversion between an alternating-current (AC) power and a direct-current (DC) power. The inverter 27 converts an AC power generated by the electric motor-generator 25 into an DC power, and stores the DC power in the electric energy storage system 28 (charging operation). Also, The inverter 27 converts a DC power stored in the electric energy storage system 28 into an AC power, and supplies the AC power to the electric motor-generator 25 (discharging operation). Also, the inverter 27 stops, switches, or starts the charging/discharging operation in response to a control signal from the controller 30, and outputs a piece of information about the charging/discharging operation to the controller 30.

The electric energy storage system 28 is a system configured to store a DC power. For example, the electric energy storage system 28 includes a capacitor, a step-down (buck)/step-up (boost) converter and a DC bus. The DC bus controls delivery and receipt of electric power between the capacitor and the electric motor-generator 25. The capacitor includes a capacitor voltage detecting part configured to detect a capacitor voltage value and a capacitor current detecting part configured to detect a capacitor current value. The capacitor voltage detecting part and the capacitor current detecting part output a capacitor voltage value and a capacitor current value to the controller 30, respectively. There has been explained about a capacitor as an example above. However, a chargeable/dischargeable secondary battery such as a lithium-ion battery or other forms of power source capable of delivering and receiving electric power may be used instead of the capacitor.

The electric turning mechanism mainly includes an inverter 35, a turning gearbox 36, an electric turning motor-generator 37, a resolver 38, and a mechanical brake 39.

The inverter 35 is a device configured to perform a conversion between an AC power and a DC power. The inverter 35 converts an AC power generated by the electric turning motor-generator 37 into an DC power, and stores the DC power in the electric energy storage system 28 (charging operation). Also, the inverter 35 converts a DC power stored in the electric energy storage system 28 into an AC power, and supplies the AC power to the electric turning motor-generator 37 (discharging operation). Also, the inverter 35 stops, switches, or starts the charging/discharging operation in response to a control signal from the controller 30, and outputs a piece of information about the charging/discharging operation to the controller 30.

The turning gearbox 36 is a transmission mechanism configured to include an input shaft and an output shaft. The input shaft is coupled to a rotating shaft of the electric turning motor-generator 37, and the output shaft is coupled to a rotating shaft of the turning mechanism 2.

The electric turning motor-generator 37 is a device configured to selectively perform a power running operation for turning the turning mechanism 2 by using electric power stored in the electric energy storage system 28, or a regenerative operation for converting kinetic energy of the turning mechanism 2 to electric energy.

The resolver 38 is a device configured to detect a turning speed of the turning mechanism 2 and output a detection value to the controller 30.

The mechanical brake 39 is a device configured to put a brake on the turning mechanism 2. The mechanical brake 39 mechanically prevents the turning mechanism 2 from turning in response to a control signal from the controller 30.

According to the above configuration, the hybrid shovel according to the fifth embodiment can achieve effects similar to the above effects achieved by the hydraulic shovel according to the first embodiment.

Sixth Embodiment

Figure 13:
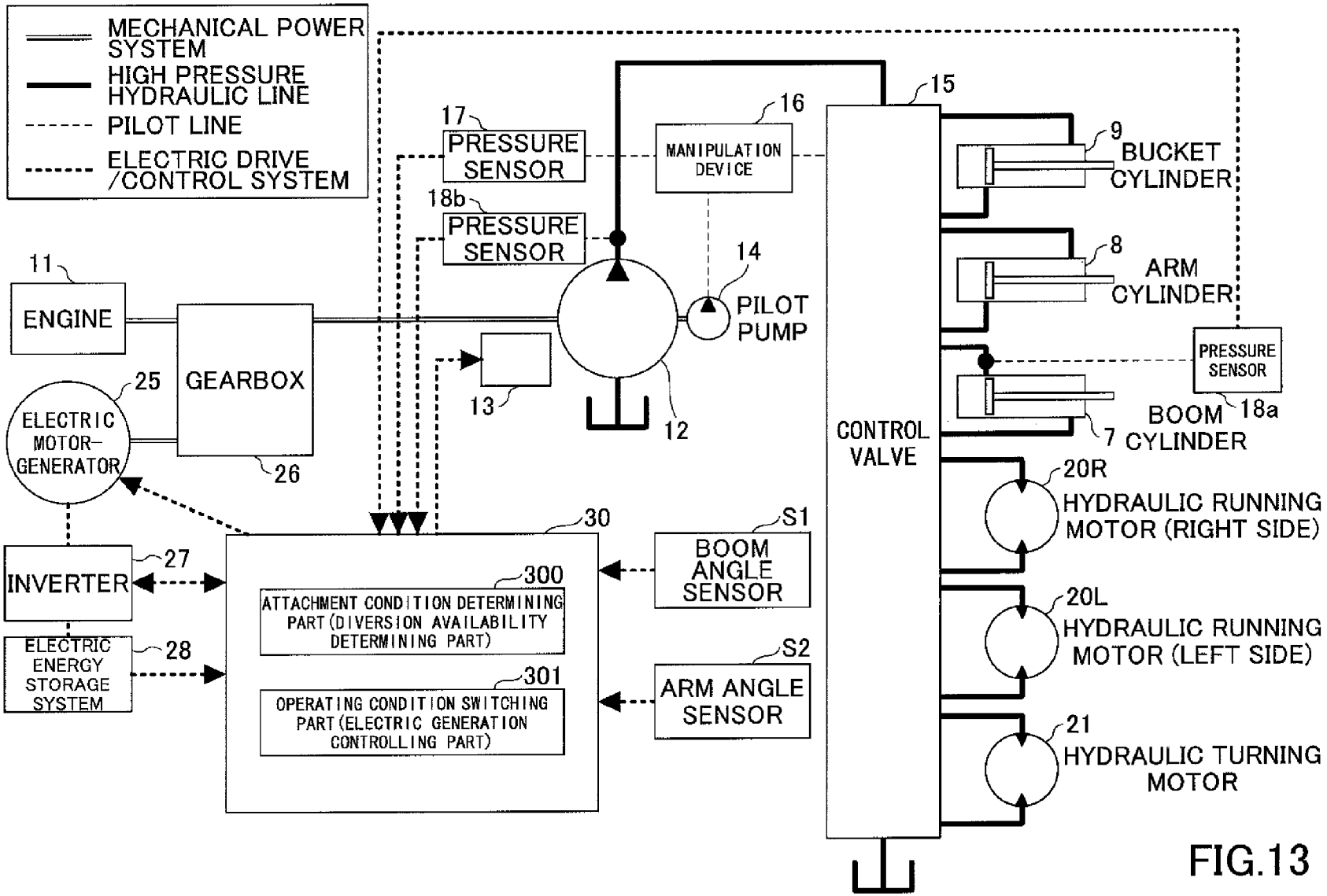
FIG. 13 is a second block diagram showing a configuration example of a drive system of the hydraulic shovel.

Next, referring to FIG. 13, there will be explained about a hydraulic shovel according to a sixth embodiment of the present invention. FIG. 13 is a block diagram showing a configuration example of a drive system of the hydraulic shovel. In FIG. 13, a mechanical power system, a high pressure hydraulic line, a pilot line, and an electric drive/control system are indicated by a double line, a solid line, a dashed line, and a dotted line, respectively.

Specifically, the controller 30 receives detection values from the boom angle sensor S1, the pressure sensor 17, the boom cylinder pressure sensor 18*a*, the discharge pressure sensor 18*b*, the inverter 27, the electric energy storage system 28, and the like. Then, based on the detection values, the controller 30 performs a process achieved by each of a diversion availability determining part 300 as the attachment condition determining part and an electric generation controlling part 301 as the operating condition switching part. Then, the controller 30 appropriately outputs a control signal to the regulator 13 and the inverter 27. The control signal corresponds to the processing result of each of the diversion availability determining part 300 and the electric generation controlling part 301.

More specifically, the diversion availability determining part 300 in the controller 30 determines whether it is possible to divert a part of an engine output being used for driving the main pump 12 to an operation of the electric motor-generator 25. Then, if the diversion availability determining part 300 determines that the diversion is possible, the electric generation controlling part 301 in the controller 30 adjusts the regulator 13 so as to decrease a discharge rate of the main pump 12 and gets the electric generation by the electric motor-generator 25 started. In what follows, a state where the discharge rate of the main pump 12 has been decreased and the electric generation has been started is referred to as a "discharge rate decreased/electricity-generating state", and a state before being switched to a discharge rate decreased/electricity-generating state is referred to as a "normal state".

Figure 14:
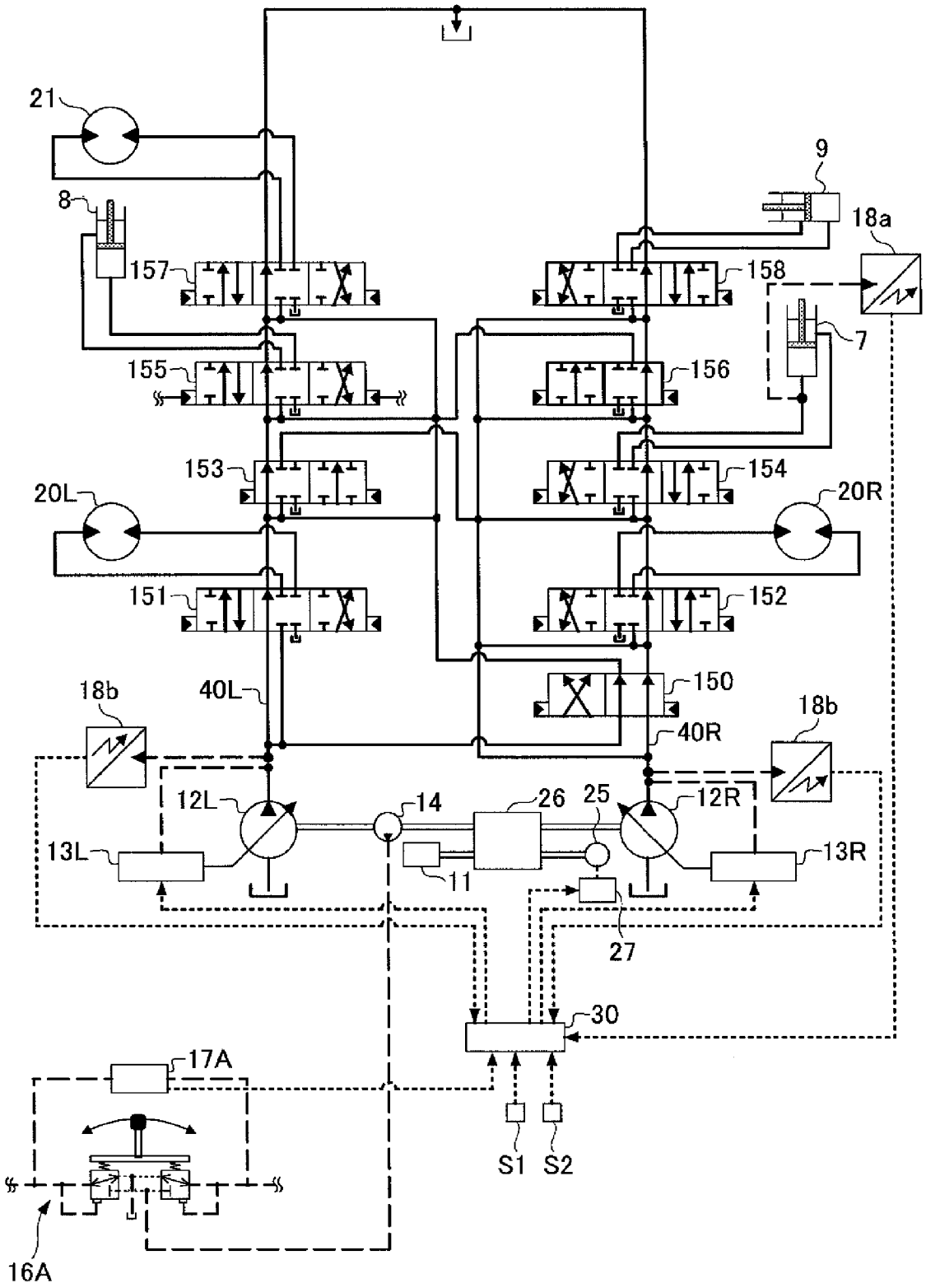
FIG. 14 is a third schematic diagram showing a configuration example of a hydraulic system installed in the hydraulic shovel.

Next, referring to FIG. 14, there will be explained about a mechanism configured to decrease a discharge rate of the main pump 12 and to get electric generation started. FIG. 14 is a schematic diagram showing a configuration example of the hydraulic system installed in the hydraulic shovel according to the sixth embodiment. In FIG. 14, as is the case in FIG. 13, a mechanical power system, a high pressure hydraulic line, a pilot line, and an electric drive/control system are indicated by a double line, a solid line, a dashed line, and a dotted line, respectively.

The controller 30 receives outputs from the boom angle sensor S1, the arm angle sensor S2, the pressure sensor 17A, the boom cylinder pressure sensor 18*a*, the discharge pressure sensor 18*b*, and the like. Then, the controller 30 outputs a control signal to the regulators 13L, 13R and the inverter 27 as needed. This is to decrease discharge rates of the main pumps 12L, 12R, and to get electric generation by the electric motor-generator 25 started.

Figure 15:
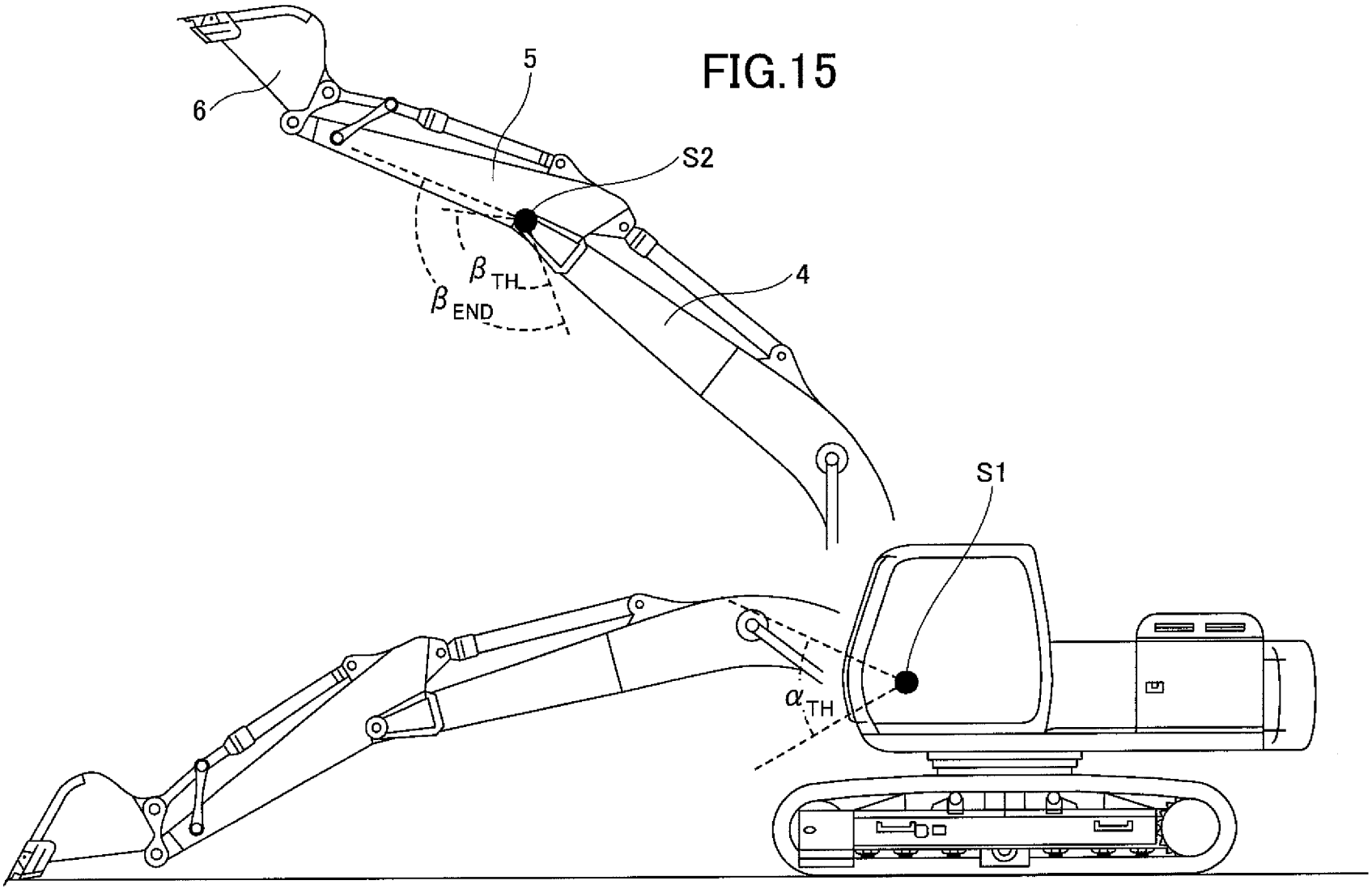
FIG. 15 is a diagram showing an example of a control-required state.
Figure 16:
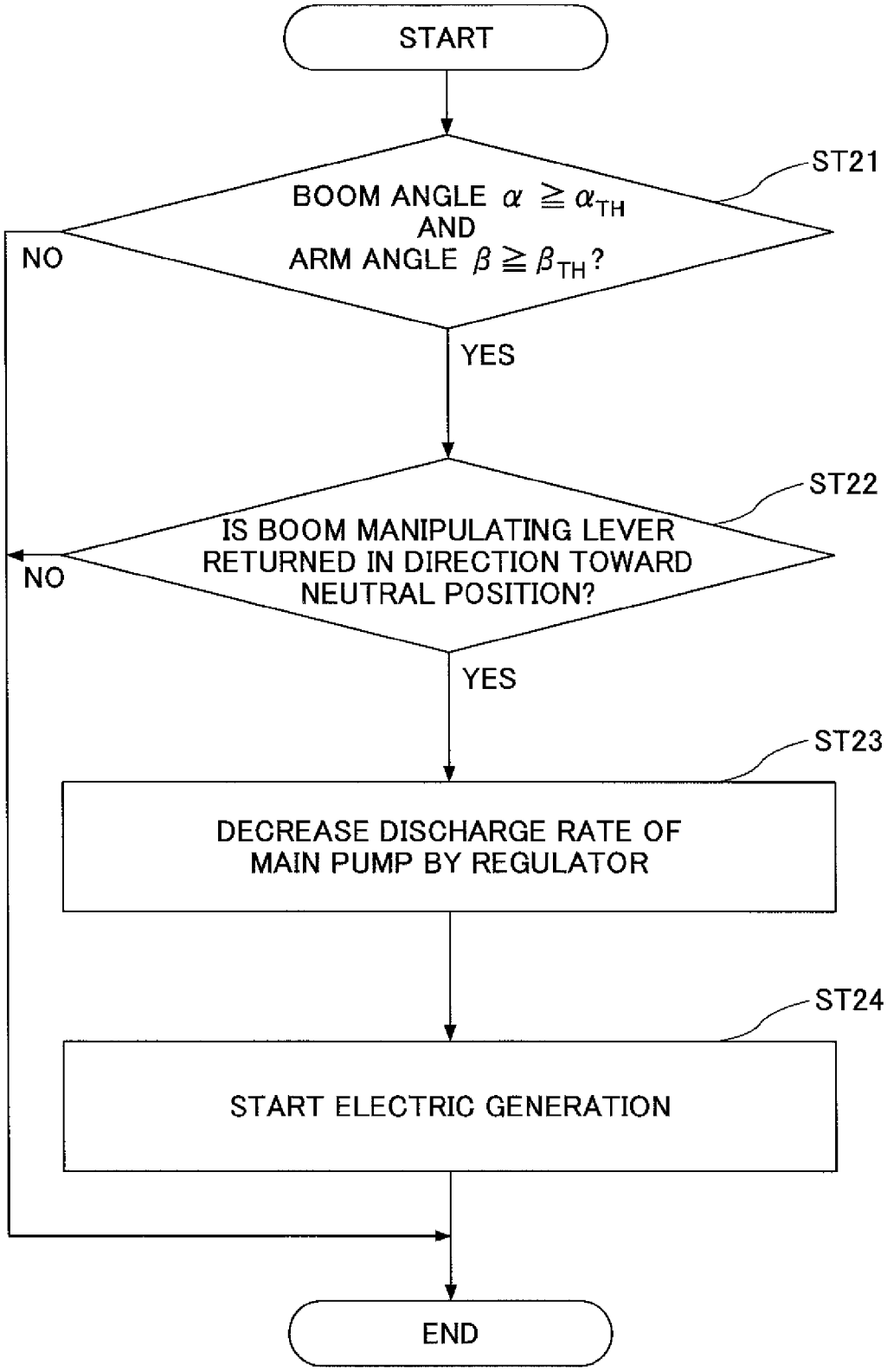
FIG. 16 is a flowchart showing a flow of an electric generation start determining process.

Next, referring to FIGS. 15-17, there will be explained about details of the hydraulic shovel according to the sixth embodiment. FIG. 15 is a schematic diagram showing an example of a control-required state adopted by the hydraulic shovel according to the sixth embodiment. Also, FIG. 15 corresponds to FIG. 4.

The hydraulic shovel according to the sixth embodiment includes an arm angle sensor S2 as a front-working-machine-condition detecting part (an arm operating condition detecting part) at a pivotally supporting part of the arm 5 (at a joint). Thus, the hydraulic shovel can detect an arm angle $\beta$ (open angle from a most closed state of the arm 5) as an inclination angle of the arm 5.

Also, the hydraulic shovel according to the sixth embodiment recognizes a state where a body stability degree of the hydraulic shovel becomes lower than or equal to a predetermined level during an operation at a leading end working range as a control-required state.

The "leading end working range" represents a working range away from the cabin 10. For example, the leading end working range corresponds to a working range which is reachable if the arm 5 has been opened widely and which is preconfigured depending on a model (a size) of the hydraulic shovel or the like.

Specifically, the diversion availability determining part 300 determines whether the boom angle $\alpha$ outputted by the boom angle sensor S1 is greater than or equal to the threshold value $\alpha_{TH}$. This is to determine whether the attachment is engaging in an excavation operation. In this case, if the boom angle $\alpha$ is lower than the threshold value $\alpha_{TH}$, the diversion availability determining part 300 determines that the bucket 6 is located under a ground surface where the crawler is located and thus the attachment is in the excavation operation. In contrast, if the boom angle $\alpha$ is greater than or equal to the threshold value $\alpha_{TH}$, it determines that the bucket 6 is located above the ground surface where the crawler is located and thus the attachment is not in the excavation operation. Also, the diversion availability determining part 300 may determine whether the attachment is in the excavation operation based on an output of the boom cylinder pressure sensor 18*a* which detects a pressure in the boom cylinder 7, the discharge pressure sensor 18*b* which detects a discharge pressure of the main pump 12, a stroke sensor (not shown) which detects a stroke amount of the boom cylinder 7, or the like, instead of based on the boom angle $\alpha$.

Also, the diversion availability determining part 300 determines whether the arm angle $\beta$ outputted by the arm angle sensor S2 is greater than or equal to the threshold value $\beta_{TH}$.

Moreover, the diversion availability determining part 300 determines whether the boom manipulating lever (not shown) has been returned toward a direction of a neutral position based on a change in an amount of manipulation of the boom manipulating lever outputted by the pressure sensor 17. This is to determine whether an operator intends to stop the boom 4.

Also, the determination whether the boom angle $\alpha$ is greater than or equal to the threshold value $\alpha_{TH}$, the determination whether the arm angle $\beta$ is greater than or equal to the threshold value $\beta_{TH}$, and the determination whether the boom manipulating lever has been returned toward the direction of the neutral position, may be performed in random order. Also, the three determinations may be performed simultaneously.

Subsequently, the diversion availability determining part 300 determines that a body stability degree of the hydraulic shovel has become lower than or equal to a predetermined level and that it is at a control-required state if the diversion availability determining part 300 determines that the boom angle $\alpha$ is greater than or equal to the threshold value $\alpha_{TH}$, that the arm angle $\beta$ is greater than or equal to the threshold value $\beta_{TH}$, and that the boom manipulating lever has been returned toward the direction of the neutral position. This is because a return action to the attachment is estimated to become greater in a case of stopping the boom 4 while keeping the arm 5 wide open.

Also, if the diversion availability determining part 300 determines that the arm angle $\beta$ is greater than or equal to the threshold value $\beta_{TH}$ and that the boom manipulating lever has been returned toward the direction of the neutral position, independently of a value of the boom angle $\alpha$, the diversion availability determining part 300 may determine that a body stability degree of the hydraulic shovel becomes lower than or equal to the predetermined level and that it is at a control-required state. This is because the attachment is not always in the excavation operation even if the bucket 6 is located under a ground surface where the crawler is located.

Also, the diversion availability determining part 300 may determine whether the boom angle $\alpha$ is greater than or equal to the threshold value $\alpha_{TH}$, or whether the arm angle $\beta$ is greater than or equal to the threshold value $\beta_{TH}$, based on an output of a proximity sensor, a stroke sensor (both not shown), or the like which detects that the boom 4 or the arm 5 has been lifted or opened to a predetermined angle.

Also, the diversion availability determining part 300 may determine whether a decrease in magnitude of the change per unit time $\Delta\alpha$ of the boom angle $\alpha$ has started, based on a change in the boom angle $\alpha$ outputted by the boom angle sensor S1, and thus may determine that an operator has started to stop the boom 4. In this case, the diversion availability determining part 300 may determine that a body stability degree of the hydraulic shovel at the time of stopping the boom 4 becomes lower than or equal to the predetermined level and that it is at a control-required state if the diversion availability determining part 300 determines that the arm angle $\beta$ is greater than or equal to the threshold value $\beta_{TH}$ and that a decrease in $\Delta\alpha$ has started.

The electric generation controlling part 301 gets the electric generation started while decreasing a discharge rate of the main pump 12 by outputting a control signal to the regulator 13 and the inverter 27 if the diversion availability determining part 300 determines that it is at a control-required state.

Next, referring to FIG. 16, there will be explained about an electric generation start determining process performed in the sixth embodiment. FIG. 16 is a flowchart showing a flow of the electric generation start determining process. The controller 30 repeatedly performs this electric generation start determining process at predetermined intervals until the electric generation controlling part 301 decreases a discharge rate of the main pump 12 and gets the electric generation by the electric motor-generator 25 started.

Firstly, the diversion availability determining part 300 in the controller 30 determines whether a body stability degree of the hydraulic shovel at the time of stopping the boom 4 becomes lower than or equal to a predetermined level, i.e., whether an operator intends to stop the boom 4 while keeping the arm 5 wide open.

Specifically, the diversion availability determining part 300 in the controller 30 determines whether the boom angle $\alpha$ is greater than or equal to the threshold value $\alpha_{TH}$ and the arm angle $\beta$ is greater than or equal to the threshold value $\beta_{TH}$ (step ST21).

If the controller 30 determines that the boom angle $\alpha$ is lower than the threshold value $\alpha_{TH}$ or the arm angle $\beta$ is lower than the threshold value $\beta_{TH}$ (NO in step ST21), the controller 30 terminates this turn of the electric generation start determining process without decreasing a discharge rate of the main pump 12. This is because, even if the operator has stopped the working boom 4, a body stability degree of the hydraulic shovel does not become lower than or equal to the predetermined level.

In contrast, if the controller 30 determines that the boom angle $\alpha$ is greater than or equal to the threshold value $\alpha_{TH}$ and the arm angle $\beta$ is greater than or equal to the threshold value $\beta_{TH}$ (YES in step ST21), the controller 30 determines whether the boom manipulating lever has been returned toward a direction of a neutral position (step ST22). Specifically, the diversion availability determining part 300 in the controller 30 determines whether the boom manipulating lever, which had been manipulated toward a direction of lever manipulation for lifting or lowering the boom 4, has been returned toward the direction of the neutral position.

If the controller 30 determines that the boom manipulating lever has not been returned toward the direction of the neutral position (NO in step ST22), the controller 30 terminates this turn of the electric generation start determining process without decreasing a discharge rate of the main pump 12. This is because the operator is in the middle of accelerating the boom 4 or operating the boom 4 at constant speed and thus a posture of the hydraulic shovel is relatively stable.

In contrast, if the controller 30 determines that the boom manipulating lever has been returned toward the direction of the neutral position (YES in step ST22), the electric generation controlling part 301 in the controller 30 outputs a control signal to the regulator 13 so as to decrease a discharge rate of the main pump 12 (step ST23). This is to prevent a return action at the time of stopping the boom 4 from being large by slowing down a movement of the boom 4 before stopping the boom 4.

Specifically, the electric generation controlling part 301 outputs a control signal to the regulator 13, adjusts the regulator 13, and thus decreases a discharge rate of the main pump 12. Thus, the electric generation controlling part 301 can decrease a horsepower of the main pump 12 by decreasing a discharge rate Q of the main pump 12.

Subsequently, the electric generation controlling part 301 outputs a control signal to the inverter 27 so as to get the electric generation by the electric motor-generator 25 started (step ST24). If the electricity generating operation has already been started, the controller 30 further increases an output of the electric generation by the electric motor-generator 25 in step ST24.

In this way, the controller 30 decreases a discharge rate of the main pump 12 and slows down a movement of the decelerating boom 4. Thus, the controller 30 can reduce a return action at the time of stopping the boom 4 and can improve a body stability degree of the hydraulic shovel.

Also, the controller 30 decreases a load on the engine 11 by decreasing a discharge rate of the main pump 12 so as to allow an output of the engine 11 to be diverted to an operation of the electric motor-generator 25. Thus, the controller 30 can improve energy efficiency of the hydraulic shovel.

Figure 17:
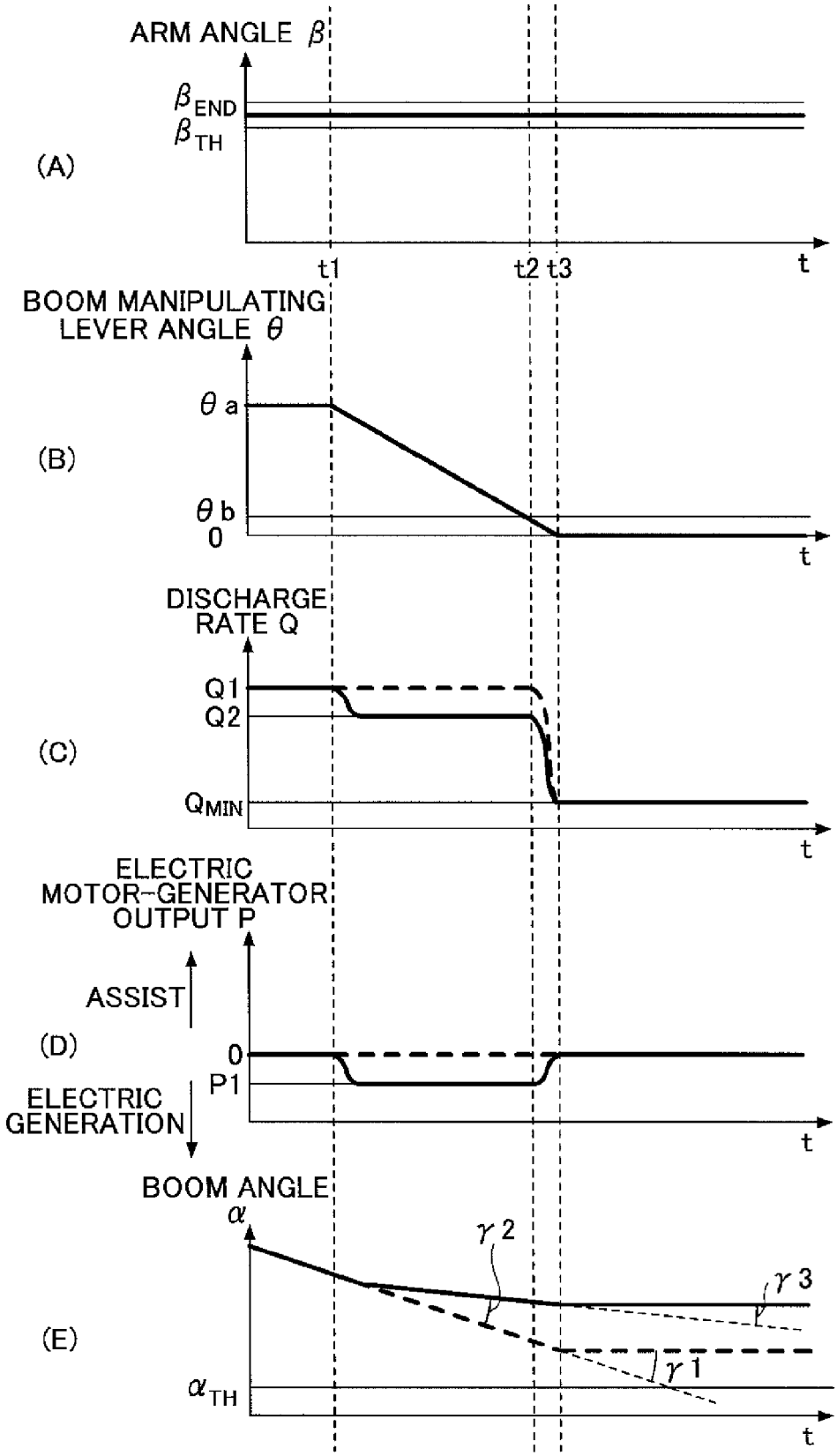
FIG. 17 is a first diagram showing changes in various physical quantities in a case of diverting a part of an engine output being used for driving a main pump to an operation of an electric motor-generator.

FIG. 17 is a diagram showing temporal changes in an arm angle $\beta$, a boom manipulating lever angle $\theta$, a discharge rate Q of the main pump 12, and a boom angle $\alpha$ in a case where the controller 30 diverts a part of an output of the engine 11 being used for driving the main pump 12 to an operation of the electric motor-generator 25.

FIG. 17(A) shows a change in the arm angle $\beta$, and FIG. 17(B) shows a change in the boom manipulating lever angle $\theta$. Also, a range from a neutral position 0 to a first bounding angle $\theta b$ in FIG. 17(B) is a dead band range. In the dead band range, even if the boom manipulating lever has been manipulated, the boom 4 does not move and the discharge rate Q of the main pump 12 does not increase, either. A range from an angle θa to the first bounding angle θb in FIG. 17(B) is a normal operation range. In the normal operation range, the boom 4 moves in response to the boom manipulating lever.

In FIG. 17(C), a solid line indicates a change in the discharge rate Q of the main pump 12 in a case where the discharge rate Q is controlled at a discharge rate decreased/electricity-generating state, and a dashed line indicates a change in the discharge rate Q of the main pump 12 in a case where the discharge rate Q is not controlled at a discharge rate decreased/electricity-generating state. A discharge rate Q1 indicates a discharge rate at a normal state. In the sixth embodiment, the discharge rate Q1 is a maximum discharge rate. Also, a discharge rate Q2 indicates a discharge rate at a discharge rate decreased/electricity-generating state.

In FIG. 17(D), a solid line indicates a change in the electric motor-generator output P in a case where the discharge rate Q is controlled at a discharge rate decreased/electricity-generating state, and a dashed line indicates a change in the electric motor-generator output P in a case where the discharge rate Q is not controlled at a discharge rate decreased/electricity-generating state.

In FIG. 17(E), a solid line indicates a change in the boom angle α in a case where the discharge rate Q is controlled at a discharge rate decreased/electricity-generating state, and a dashed line indicates a change in the boom angle α in a case where the discharge rate Q is not controlled at a discharge rate decreased/electricity-generating state.

At a time point 0, the arm angle β is already close to the maximum angle $\beta_{END}$ above the threshold value $\beta_{TH}$, the hydraulic shovel is at a state where the arm 5 is opened widely. At this state, an operator is tilting the boom manipulating lever toward a direction for lowering the boom 4 to a maximum extent. Thus, the boom manipulating lever angle θ is at a maximum angle θa.

From the time point 0 to a time point t1, the operator is tilting the boom manipulating lever toward a direction for lowering the boom 4 to a maximum extent. Thus, the boom angle α decreases as time goes by. At this time, the discharge rate Q of the main pump 12 is at the maximum discharge rate Q1.

If the discharge rate Q is not controlled at a discharge rate decreased/electricity-generating state, even if the operator has started to return the boom manipulating lever from the maximum angle θa toward the direction of the neutral position 0 at the time point t1, the discharge rate Q of the maim pump 12 remains unchanged and the main pump 12 continues to discharge at the maximum discharge rate Q1. Thus, the boom angle α continues to decrease at the same angular rate as an angular rate between the time point 0 and the time point t1. Also, the electric motor-generator output P remains unchanged and at a value of zero.

Then, at a time point t2, if the boom manipulating lever angle θ exceeds the first bounding angle θb and enters into the dead band range, the discharge rate Q of the main pump 12 decreases rapidly and reaches a minimum discharge rate $Q_{MIN}$ at a time point t3. In this way, the discharge rate Q of the main pump 12 rapidly decreases to the minimum discharge rate $Q_{MIN}$. Thus, the boom 4, which has been descending at constant angular rate, comes to a sudden stop at the time point t3.

If the discharge rate Q is controlled at a discharge rate decreased/electricity-generating state, when the operator has started to return the boom manipulating lever from the maximum angle θa toward the direction of the neutral position 0 at the time point t1, the electric generation controlling part 301 outputs a control signal to the regulator 13 and the inverter 27. Thus, the regulator 13 is adjusted and the discharge rate Q of the main pump 12 is decreased from the discharge rate Q1 to the discharge rate Q2 set for a discharge rate decreased/electricity-generating state. With a decrease in the discharge rate Q of the main pump 12, the boom 4, which has been descending at constant angular rate, continues to descend at a lower angular rate. Also, an electric generation by the electric motor-generator 25 is started, and the electric motor-generator output P is increased from a value of zero to an electric generation output P1 at a discharge rate decreased/electricity-generating state.

Then, at the time point t2, if the boom manipulating lever angle θ enters into the dead band range, the discharge rate Q of the main pump 12 decreases from the discharge rate Q2 at a discharge rate decreased/electricity-generating state to the minimum discharge rate $Q_{MIN}$. That is, a horsepower of the main pump 12 decreases. Thus, an angular rate of the boom 4 becomes zero and the descent of the boom 4 stops. Also, the electric motor-generator output P decreases from the electric generation output P1 at a discharge rate decreased/electricity-generating state to a value of zero.

In this way, if the discharge rate Q is not controlled at a discharge rate decreased/electricity-generating state, an amount of change in an angular rate of the boom 4 takes a large value of γ1 at the time point t3. However, if the discharge rate Q is controlled at a discharge rate decreased/electricity-generating state, it is changed to γ2 and then to γ3 in a stepwise fashion. Thus, if the discharge rate Q is controlled at a discharge rate decreased/electricity-generating state, the boom 4 can stop smoothly without generating a large vibration.

Also, changes shown in FIG. 17(A)-17(E) are applicable to a case of stopping the ascending boom 4. In that case, plus and minus of the boom manipulating lever angle θ (see FIG. 17(B)) and the boom angle α (see FIG. 17(E)) are reversed, and a decreasing rate of the boom angle α (see FIG. 17(E)) is read as an increasing rate.

Also, in the sixth embodiment, even if the controller 30 determines that the boom angle α is greater than or equal to the threshold value $\alpha_{TH}$, that the arm angle β is greater than or equal to the threshold value $\beta_{TH}$, and that the boom manipulating lever has been returned toward the direction of the neutral position, if the controller 30 determines that it is during excavation, the controller 30 may cancel a reduction of a discharge rate and a start of an electric generation. This is to prevent a movement of the attachment from slowing down during excavation. Also, the determination whether it is during excavation is conducted, for example, based on an output of the boom cylinder pressure sensor 18*a*, the discharge pressure sensor 18*b*, a stroke sensor (not shown) which detects a stroke amount of the boom cylinder 7, or the like.

Conversely, even if the boom angle α is lower than the threshold value $\alpha_{TH}$, if the controller 30 determines that it is not during excavation, the controller 30 may decrease a discharge rate of the main pump 12 and get an electric generation started when the controller 30 determines that the arm angle β is greater than or equal to the threshold value $\beta_{TH}$, and that the boom manipulating lever has been returned toward the direction of the neutral position.

According to the above configuration, the hydraulic shovel according to the sixth embodiment decreases a discharge rate of the main pump 12 by adjusting the regulator 13 if it determines that a body stability degree of the hydraulic shovel in a case of stopping the boom 4 while keeping the arm 5 wide open becomes lower than or equal to a predetermined level. As a result, the hydraulic shovel can stop the boom 4 while slowing down a movement of the boom 4 in a stepwise fashion, and thus can improve a body stability degree of the hydraulic shovel at the time of stopping the boom 4.

Also, the hydraulic shovel according to the sixth embodiment decreases a load on the engine 11 for driving the main pump 12 by decreasing a discharge rate of the main pump 12 so as to allow an output of the engine 11 to be diverted to an operation of the electric motor-generator 25. On that basis, the hydraulic shovel gets the electric generation by the electric motor-generator 25 started. As a result, the hydraulic shovel according to the sixth embodiment can improve energy efficiency by generating electricity through using an engine output which has been wasted.

Also, the hydraulic shovel according to the sixth embodiment decreases the discharge rate of the main pump 12 by adjusting the regulator 13. Thus, the hydraulic shovel can easily and reliably improve a body stability degree and energy efficiency of the hydraulic shovel in a case of stopping the boom 4.

In the sixth embodiment, an example using the arm angle sensor S2 as the arm operating condition detecting part has been explained. However, a sensor which detects a stroke amount of the arm cylinder 8, a proximity sensor which detects that the arm 5 has been opened to a predetermined angle, or the like may be used as the arm operating condition detecting part.

Seventh Embodiment

Next, referring to FIGS. 18 and 19, there will be explained about a hydraulic shovel according to a seventh embodiment of the present invention.

The hydraulic shovel according to the seventh embodiment differs from the hydraulic shovel according to the six embodiment in that the hydraulic shovel according to the seventh embodiment changes a discharge rate of the main pump 12 using a negative control regulation. Otherwise, both are common.

Thus, there will be explained about the differences in detail while omitting an explanation of the common points. Also, the same reference numbers as those used for explaining the hydraulic shovel according to the sixth embodiment are used. Also, the drive system shown in FIG. 13 is installed in the hydraulic shovel according to the seventh embodiment.

Figure 18:
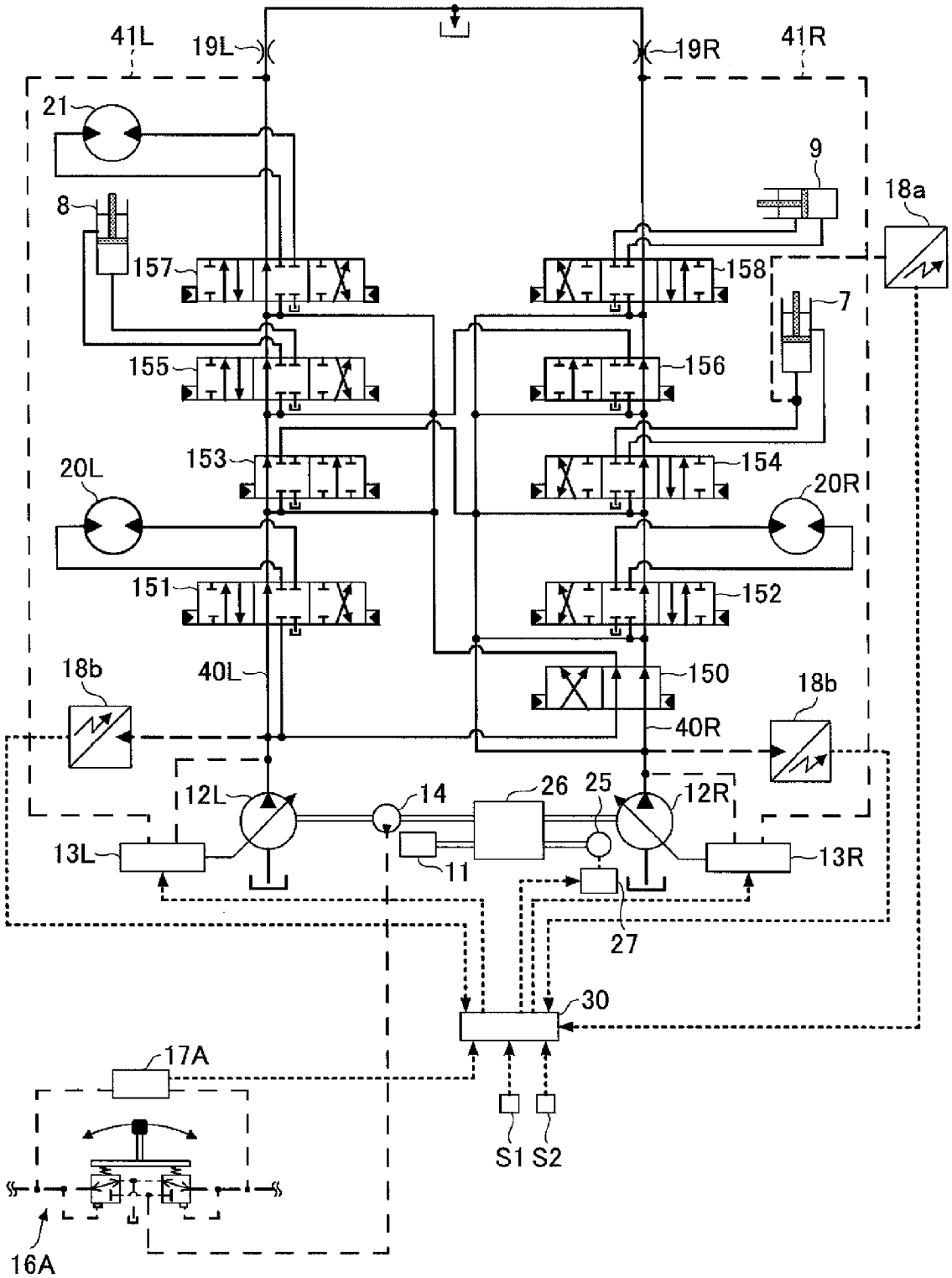
FIG. 18 is a fourth schematic diagram showing a configuration example of a hydraulic system installed in the hydraulic shovel.

FIG. 18 is a schematic diagram showing a configuration example of a hydraulic system installed in the hydraulic shovel according to the seventh embodiment. In FIG. 18, as is the case in FIGS. 13 and 14, a mechanical power system, a high pressure hydraulic line, a pilot line, and an electric drive/control system are indicated by a double line, a solid line, a dashed line, and a dotted line, respectively. Also, the hydraulic system shown in FIG. 18 differs from the hydraulic system shown in FIG. 14 in that the hydraulic system shown in FIG. 18 includes negative control throttles 19L, 19R and negative control pressure hydraulic lines 41L, 41R. Otherwise, both are common.

The center bypass hydraulic lines 40L, 40R include the negative control throttles 19L, 19R between each of the flow control valves 157, 158 at the most downstream part and the hydraulic oil tank. Flows of the hydraulic oil discharged from the main pumps 12L, 12R are restricted by the negative control throttles 19L, 19R. In this way, the negative control throttles 19L, 19R create a control pressure (hereinafter referred to as a "negative control pressure") for controlling the regulators 13L, 13R.

The negative control pressure hydraulic lines 41L, 41R indicated by dashed lines are pilot lines configured to transmit the negative control pressure created upstream of the negative control throttles 19L, 19R to the regulators 13L, 13R.

The regulators 13L, 13R regulate discharge rates of the main pumps 12L, 12R by adjusting swash plate tilt angles of the main pumps 12L, 12R depending on the negative control pressure (hereinafter, this regulation is referred to as a "negative control regulation"). Also, the regulators 13L, 13R decrease discharge rates of the main pumps 12L, 12R with an increase in the negative control pressure to be transmitted, and increase discharge rates of the main pumps 12L, 12R with a decrease in the negative control pressure to be transmitted.

Specifically, as shown in FIG. 18, if any one of the hydraulic actuators in the hydraulic shovel has not been operated (hereinafter this case is referred to as a "standby mode"), the hydraulic oil discharged from the main pumps 12L, 12R reaches the negative control throttles 19L, 19R through the center bypass hydraulic lines 40L, 40R. Then, flows of the hydraulic oil discharged from the main pumps 12L, 12R increase negative control pressure created upstream of the negative control throttles 19L, 19R. As a result, the regulators 13L, 13R decrease the discharge rates of the main pumps 12L, 12R to the minimum allowable discharge rate, and thus reduce a pressure loss (a pumping loss) when the discharged hydraulic oil passes through the center bypass hydraulic lines 40L, 40R.

In contrast, if any one of the hydraulic actuators in the hydraulic shovel has been operated, the hydraulic oil discharged from the main pumps 12L, 12R flows into a hydraulic actuator to be operated via a flow control valve corresponding to the hydraulic actuator to be operated. Then, flows of the hydraulic oil discharged from the main pumps 12L, 12R decrease or eliminate an amount of hydraulic oil which reaches the negative control throttles 19L, 19R, and thus decrease the negative control pressure created upstream of the negative control throttles 19L, 19R. As a result, the regulators 13L, 13R receiving the decreased negative control pressure increase the discharge rates of the main pump 12L, 12R, circulate sufficient hydraulic oil to the hydraulic actuator to be operated, and thus ensure an operation of the hydraulic actuator to be operated.

According to the above configuration, the hydraulic system in FIG. 18 can reduce unnecessary energy consumption in the main pumps 12L, 12R (a pumping loss in the center bypass hydraulic lines 40L, 40R caused by the hydraulic oil discharged from the main pumps 12L, 12R) at the standby mode.

Also, if the hydraulic system in FIG. 18 operates a hydraulic actuator, the hydraulic system allows the main pumps 12L, 12R to reliably supply a necessary and sufficient hydraulic oil to the hydraulic actuator to be operated.

Figure 19:
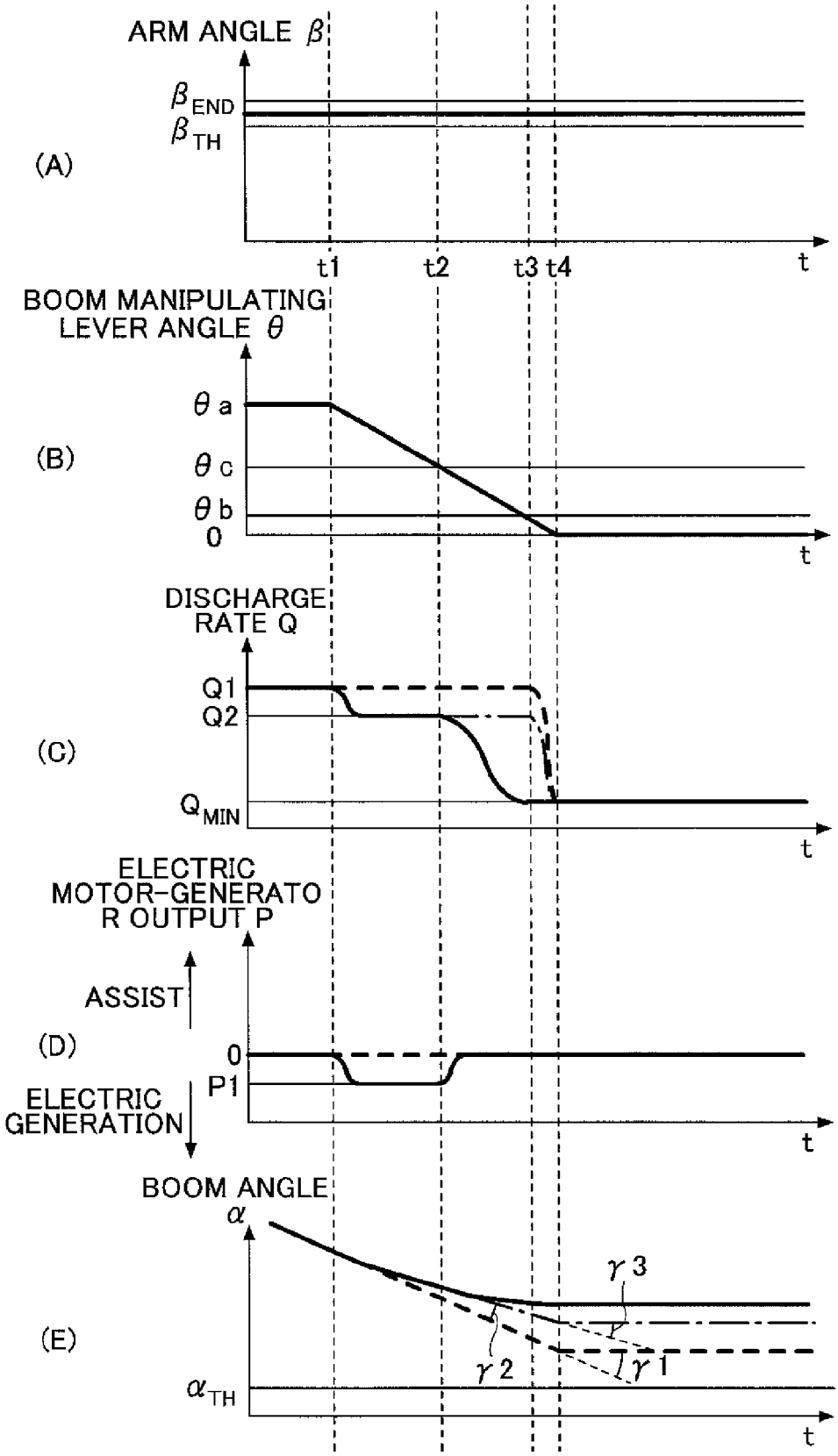
FIG. 19 is a second diagram showing changes in various physical quantities in a case of diverting a part of an engine output being used for driving a main pump to an operation of an electric motor-generator.

As is the case in FIG. 17, FIG. 19 shows temporal changes in an arm angle $\beta$, a boom manipulating lever angle $\theta$, a discharge rate Q of the main pump 12, an electric motor-generator output P, and a boom angle $\alpha$ in a case where the controller 30 diverts a part of an engine output being used for driving the main pump 12 to an operation of the electric motor-generator 25.

At FIGS. 19(C) and 19(E), solid lines show changes in the discharge rate Q of the main pump 12 and the boom angle $\alpha$ in a case where the discharge rate Q is controlled under the negative control regulation after having been controlled at a discharge rate decreased/electricity-generating state, dashed-dotted lines show changes in the discharge rate Q of the main pump 12 and the boom angle $\alpha$ in a case where the discharge rate Q is not controlled under the negative control regulation after having been controlled at a discharge rate decreased/electricity-generating state, and dashed lines show changes in the discharge rate Q of the main pump 12 and the boom angle $\alpha$ in a case where the discharge rate Q is not controlled either under the negative control regulation or at a discharge rate decreased/electricity-generating state. Also, a range from a neutral position 0 to a first bounding angle $\theta b$ in FIG. 19(B) is a dead band range, and a range from the first bounding angle $\theta b$ to a second bounding angle $\theta c$ in FIG. 19(B) is a negative control regulation range where the negative control regulation is performed.

At a time point 0, as is the case in FIG. 17, the arm angle $\beta$ is already close to the maximum angle $\beta_{END}$ above the threshold value $\beta_{TH}$, the hydraulic shovel is at a state where the arm 5 is opened widely. At this state, an operator is tilting the boom manipulating lever toward a direction for lowering the boom 4 to a maximum extent. Thus, the boom manipulating lever angle $\theta$ is at a maximum angle $\theta a$.

From the time point 0 to a time point t1, the operator is tilting the boom manipulating lever toward a direction for lowering the boom 4 to a maximum extent. Thus, the boom angle $\alpha$ decreases as time goes by. At this time, the discharge rate Q of the main pump 12 is at the maximum discharge rate Q1.

If the discharge rate Q is controlled at a discharge rate decreased/electricity-generating state, when the operator has started to return the boom manipulating lever from the maximum angle $\theta a$ toward the direction of the neutral position 0 at the time point t1, the electric generation controlling part 301 outputs a control signal to the regulator 13 and the inverter 27. Thus, the regulator 13 is adjusted, the discharge rate Q of the main pump 12 is decreased from the discharge rate Q1 to the discharge rate Q2 at a discharge rate decreased/electricity-generating state, and a horsepower of the main pump 12 decreases. Thus, the boom 4, which has been descending at constant angular rate, continues to descend at an angular rate decreased by $\gamma 2$, with a decrease in the discharge rate Q of the main pump 12. Also, an electric generation by the electric motor-generator 25 is started, and the electric motor-generator output P is increased from a value of zero to an electric generation output P1 at a discharge rate decreased/electricity-generating state.

In a case where the negative control regulation is not performed, as indicated by a dashed-dotted line, even if the boom manipulating lever angle $\theta$ has become lower than the second bounding angle $\theta c$ at the time point t2, the discharge rate Q of the main pump 12 remains unchanged, and the main pump 12 continues to discharge at the discharge rate Q2 set for a discharge rate decreased/electricity-generating state. Thus, the boom angle $\alpha$ continues to decrease at the same angular rate as an angular rate between the time point t1 and the time point t2.

Then, at a time point t3, if the boom manipulating lever angle $\theta$ exceeds the first bounding angle $\theta b$ and enters into the dead band range, the discharge rate Q of the main pump 12 decreases to a minimum discharge rate $Q_{MIN}$. In this way, the discharge rate Q of the main pump 12 decreases to the minimum discharge rate $Q_{MIN}$. Thus, the boom 4, which has been descending at constant angular rate, stops just after the time point t3. At this time, an amount of change in the angular rate of the boom 4 is $\gamma 3$.

After the discharge rate Q has been controlled at a discharge rate decreased/electricity-generating state, if the negative control regulation is supposed to be performed, as indicated by a solid line, when the boom manipulating lever angle $\theta$ becomes lower than the second bounding angle $\theta c$ at the time point t2, the negative control regulation is performed. As a result, the discharge rate Q decreases according to the negative control pressure which gradually increases as the boom manipulating lever is returned toward a direction of the neutral position. The boom 4, which has been descending at constant angular rate, continues to descend at a lower angular rate, with a decrease in the discharge rate Q of the main pump 12. Also, the electric motor-generator output P decreases from the electric generation output P1 at a discharge rate decreased/electricity-generating state to a value of zero.

Then, at a time point t3, if the boom manipulating lever angle $\theta$ enters into the dead band range, the discharge rate Q of the main pump 12 becomes the minimum discharge rate $Q_{MIN}$. That is, a horsepower of the main pump 12 decreases. Thus, an angular rate of the boom 4 becomes zero and the descent of the boom 4 stops.

In this way, if the negative control regulation is performed after the discharge rate Q has been controlled at a discharge rate decreased/electricity-generating state, the discharge rate Q of the main pump 12 gradually decreases with an increase in the negative control pressure after the time point t2. Thus, an angular rate of the boom 4 gradually decreases. As a result, in comparison to a case where the negative control regulation is not performed, it is possible to reduce a vibration of the boom 4 and to stop the boom 4 smoothly.

Also, changes shown in FIG. 19(A)-19(E) are applicable to a case of stopping the ascending boom 4. In that case, plus and minus of the boom manipulating lever angle $\theta$ (see FIG. 19(B)) and the boom angle $\alpha$ (see FIG. 19(E)) are reversed, and a decreasing rate of the boom angle $\alpha$ (see FIG. 19(E)) is read as an increasing rate.

Also, in the seventh embodiment, even if the controller 30 determines that the boom angle $\alpha$ is greater than or equal to the threshold value $\alpha_{TH}$, that the arm angle $\beta$ is greater than or equal to the threshold value $\beta_{TH}$, and that the boom manipulating lever has been returned toward the direction of the neutral position, if the controller 30 determines that it is during excavation, the controller 30 may cancel a reduction of a discharge rate and a start of an electric generation. This is to prevent a movement of the attachment from slowing down during excavation. Also, the determination whether it is during excavation is conducted, for example, based on an output of the boom cylinder pressure sensor 18*a*, the discharge pressure sensor 18*b*, a stroke sensor (not shown) which detects a stroke amount of the boom cylinder 7, or the like.

Conversely, even if the boom angle $\alpha$ is lower than the threshold value $\alpha_{TH}$, if the controller 30 determines that it is not during excavation, the controller 30 may decrease a discharge rate of the main pump 12 and get an electric generation started when the controller 30 determines that the arm angle $\beta$ is greater than or equal to the threshold value $\beta_{TH}$, and that the boom manipulating lever has been returned toward the direction of the neutral position.

According to the above configuration, the hybrid shovel according to the seventh embodiment can achieve effects similar to the effects achieved by the hydraulic shovel according to the sixth embodiment.

Also, the hydraulic shovel according to the seventh embodiment further decreases a discharge rate of the main pump 12 by getting the negative control regulation started when the boom manipulating lever angle $\theta$ has entered into the negative control regulation range. As a result, the hydraulic shovel according to the seventh embodiment can stop the boom 4 while further slowing down a movement of the boom 4 in a stepwise fashion, and thus can further improve a body stability degree of the hydraulic shovel at the time of stopping the boom 4.

Also, in the sixth and seventh embodiments, there has been explained about a case where the electric generation controlling part 301 gets the electric generation by the electric motor-generator 25 started. However, if the electric generation controlling part 301 has already got the electricity generating operation started before a body stability degree becomes lower than or equal to a predetermined level during an operation at a leading end working range, the electric generation controlling part 301 further increases an electric generation output by the electric motor-generator 25 after the body stability degree has become lower than or equal to the predetermined level. In this way, the electric generation controlling part 301 can perform the electricity generating operation by the electric motor-generator 25 efficiently by decreasing a horsepower of the main pump 12.

Also, as is the case in the sixth and the seventh embodiments, the hybrid shovel according to the fifth embodiment may decease a discharge rate of the main pump 12 and may get the electric generation by the electric motor-generator 25 started, if a body stability degree of the hybrid shovel becomes lower than or equal to a predetermined level during an operation at a leading end working range.

There has been explained preferable embodiments of the present invention in detail. However, the present invention is not intended to be limited to the above described embodiments. Various modifications, substitutions, or the like may be made to the above embodiments without deviating from the scope of the present invention.

For example, in the above embodiments, the discharge rate controlling part 301 may output a control signal to both the engine 11 and the regulators 13L, 13R as needed. This is to decrease discharge rates of the main pumps 12L, 12R by decreasing a rotational speed of the engine 11 and by adjusting the regulators 13L, 13R.

Also, in the above embodiments, the discharge rate controlling part 301 adjusts a discharge rate of the main pump 12 in two steps, or adjusts an engine rotational speed of the engine 11 in two steps. However, the discharge rate controlling part 301 may adjust them in three or more steps.

Also, in the above embodiments, the electric generation controlling part 301 adjusts a discharge rate of the main pump 12 and an electric generation output by the electric motor-generator 25 in two steps, respectively. However, the electric generation controlling part 301 may adjust them in three or more steps.

Also, the present application is based on and claims the benefit of priority of each of Japanese Patent Application No. 2011-050790, filed on Mar. 8, 2011, Japanese Patent Application No. 2011-066732, filed on Mar. 24, 2011, and Japanese Patent Application No. 2011-096414, filed on Apr. 22, 2011, and the respective contents of these Japanese Patent Applications are incorporated herein by reference in their entirety.

DESCRIPTION OF REFERENCE NUMERALS

1 lower running body
2 turning mechanism
3 upper turning body
4 boom
5 arm
6 bucket
7 boom cylinder
8 arm cylinder
9 bucket cylinder
10 cabin
11 engine
12, 12L, 12R main pump
13, 13L, 13R regulator
14 pilot pump
15 control valve
16 manipulation device
16A boom manipulating lever
17, 17A pressure sensor
18, 18L, 18R negative control throttle
18*a* boom cylinder pressure sensor
18*b* discharge pressure sensor
19L, 19R negative control throttle
20L, 20R hydraulic running motor
21 hydraulic turning motor
25 electric motor-generator
26 gearbox
27 inverter
28 electric energy storage system
30 controller
35 inverter
36 turning gearbox
37 electric turning motor-generator
38 resolver
39 mechanical brake
40L, 40R center bypass hydraulic line
41L, 41R negative control pressure hydraulic line
150-158 flow control valve
300 attachment condition determining part, body stability determining part, diversion availability determining part
301 operating condition switching part, discharge rate controlling part, electric generation controlling part
S1 boom angle sensor
S2 arm angle sensor

The invention claimed is:

1. A shovel comprising:

a front working machine driven by a hydraulic oil discharged from a main pump;

a front working machine condition detecting part configured to detect a condition of the front working machine;

an attachment condition determining part configured to determine a body stability degree of the shovel based on the condition of the front working machine; and an operating condition switching part configured to decrease a horsepower of the main pump if it is determined by the attachment condition determining part that the body stability degree becomes lower than or equal to a predetermined level.

2. The shovel as claimed in claim 1, wherein the front working machine condition detecting part includes an arm angle detecting part, the arm angle detecting part detects an open angle of an arm, and the attachment condition determining part determines that the body stability degree becomes lower than or equal to the predetermined level if the open angle of the arm is greater than or equal to a predetermined value.

3. The shovel as claimed in claim 1, wherein the operating condition switching part decreases the horsepower of the main pump by decreasing an engine rotational speed.

4. The shovel as claimed in claim 1, wherein the operating condition switching part decreases the horsepower of the main pump by adjusting a regulator.

5. The shovel as claimed in claim 1, wherein the shovel includes an electric motor-generator, the main pump and the electric motor-generator are driven by an engine, the attachment condition determining part determines whether it is possible to divert a part of an output of the engine being used for driving the main pump to an operation of the electric motor-generator based on the condition of the front working machine, and the operating condition switching part diverts the part of the output of the engine being used for driving the main pump to the operation of the electric motor-generator.

6. The shovel as claimed in claim 5, wherein the operating condition switching part decreases the horsepower of the main pump and starts an electric generation by the electric motor-generator if it is determined that it is possible to divert the part of the output of the engine being used for driving the main pump to the operation of the electric motor-generator.

7. The shovel as claimed in claim 5, wherein the front working machine condition detecting part includes an arm angle detecting part configured to detect an open angle of an arm, the attachment condition determining part determines that it is possible to divert the part of the output of the engine being used for driving the main pump to the operation of the electric motor-generator if the open angle of the arm detected by the arm angle detecting part is greater than or equal to a threshold value.

8. The shovel as claimed in claim 5, wherein the attachment condition determining part determines that it is possible to divert the part of the output of the engine being used for driving the main pump to the operation of the electric motor-generator if the attachment condition determining part determines that an end attachment of the front working machine is within a predetermined leading end working range.

9. A method for controlling a shovel including a front working machine driven by a hydraulic oil discharged from a main pump, comprising:

a front working machine condition detecting step of detecting a condition of the front working machine;

an attachment condition determining step of determining a body stability degree of the shovel based on the condition of the front working machine; and an operating condition switching step of decreasing a horsepower of the main pump if it is determined that the body stability degree becomes lower than or equal to a predetermined level in the attachment condition determining step.

10. The method for controlling as claimed in claim 9, wherein an open angle of an arm is detected in the front working machine condition detecting step, the body stability degree is determined to be lower than or equal to the predetermined level in the attachment condition determining step if an open angle of the arm is greater than or equal to a predetermined value.

11. The method for controlling as claimed in claim 9, wherein the horsepower of the main pump is decreased by decreasing an engine rotational speed in the operating condition switching step.

12. The method for controlling as claimed in claim 9, wherein the horsepower of the main pump is decreased by adjusting a regulator in the operating condition switching step.

13. The method for controlling as claimed in claim 9, wherein the shovel includes an electric motor-generator, the main pump and the electric motor-generator are driven by an engine, in the attachment condition determining step, it is determined whether it is possible to divert a part of an output of the engine being used for driving the main pump to an operation of the electric motor-generator based on the condition of the front working machine, and in the operating condition switching step, the part of the output of the engine being used for driving the main pump is diverted to the operation of the electric motor-generator.

14. The method for controlling as claimed in claim 13, wherein in the operating condition switching step, the horsepower of the main pump is decreased and an electric generation by the electric motor-generator is started if it is determined that it is possible to divert the part of the output of the engine being used for driving the main pump to the operation of the electric motor-generator.

15. The shovel as claimed in claim 2, wherein the operating condition switching part decreases the horsepower of the main pump by decreasing an engine rotational speed.

16. The shovel as claimed in claim 2, wherein the operating condition switching part decreases the horsepower of the main pump by adjusting a regulator.

17. The shovel as claimed in claim 6, wherein the front working machine condition detecting part includes an arm angle detecting part configured to detect an open angle of an arm, the attachment condition determining part determines that it is possible to divert the part of the output of the engine being used for driving the main pump to the operation of the electric motor-generator if the open angle of the arm detected by the arm angle detecting part is greater than or equal to a threshold value.

18. The shovel as claimed in claim 6, wherein the attachment condition determining part determines that it is possible to divert the part of the output of the engine being used for driving the main pump to the operation of the electric motor-generator if the attachment condition determining part determines that an end attachment of the front working machine is within a predetermined leading end working range.

19. The method for controlling as claimed in claim 10, wherein the horsepower of the main pump is decreased by decreasing an engine rotational speed in the operating condition switching step.

20. The method for controlling as claimed in claim 10, wherein the horsepower of the main pump is decreased by adjusting a regulator in the operating condition switching step.

* * * * *